US005893628A

United States Patent [19]

Byers

[11] Patent Number: 5,893,628

[45] Date of Patent: Apr. 13, 1999

[54] MULTIPLE LIGHT SYSTEMS

[76] Inventor: Thomas L. Byers, 5480 Stewart Dr., Mustang, Okla. 73064

[ * ] Notice: This patent is subject to a terminal disclaimer.

[21] Appl. No.: 08/953,776

[22] Filed: Oct. 17, 1997

Related U.S. Application Data

[63] Continuation-in-part of application No. 08/607,225, Feb. 26, 1996, Pat. No. 5,707,136.

[51] Int. Cl.[6] ..... F21P 1/02

[52] U.S. Cl. ..... 362/252; 362/249; 362/806; 362/396; 362/145

[58] Field of Search ..... 362/249, 252, 362/387, 396, 391, 806, 145, 389, 234, 151, 152, 147; 439/419, 533, 573, 532, 540, 569, 570, 571; 206/419, 420, 421

[56] References Cited

U.S. PATENT DOCUMENTS

| | | | |
|---|---|---|---|
| 2,889,451 | 6/1959 | Longo | 240/52 |
| 3,189,310 | 6/1965 | Trueson | 248/314 |
| 3,204,090 | 8/1965 | Kvarda, Jr. | 240/10 |
| 3,384,227 | 5/1968 | Spatz | 206/65 |
| 3,404,268 | 10/1968 | Fowler | 240/10 |
| 3,540,687 | 11/1970 | Cuva | 248/316 |
| 4,128,863 | 12/1978 | Premetz | 362/249 |
| 4,357,653 | 11/1982 | Kovacs | 362/388 |
| 4,491,902 | 1/1985 | Cangelosi | 362/389 |
| 4,769,749 | 9/1988 | Felski | 362/250 |
| 4,777,573 | 10/1988 | Liao | 362/249 |
| 5,024,406 | 6/1991 | Ketcham | 248/149 |
| 5,033,619 | 7/1991 | Garis | 206/419 |
| 5,036,447 | 7/1991 | Taylor | 362/431 |
| 5,064,067 | 11/1991 | McAllister et al. | 206/420 |
| 5,067,061 | 11/1991 | Prickett | 362/145 |
| 5,110,078 | 5/1992 | Gary | 248/206.2 |
| 5,168,999 | 12/1992 | Lee et al. | 206/420 |
| 5,238,425 | 8/1993 | Kliewer | 439/541 |
| 5,297,013 | 3/1994 | Hall et al. | 362/363 |
| 5,317,491 | 5/1994 | Lee | 362/249 |
| 5,355,288 | 10/1994 | Maddock | 362/238 |
| 5,442,531 | 8/1995 | Lee | 362/249 |
| 5,513,081 | 4/1996 | Byers | 362/145 |
| 5,526,246 | 6/1996 | Liou | 362/252 |

*Primary Examiner*—Thomas M. Sember
*Attorney, Agent, or Firm*—McAfee & Taft

[57] ABSTRACT

Improvements in components for mounting decorative light strings to various mounting sites include a plurality of track channels for holding light strings. Track channels may be attached to the mounting site with various fasteners or with snap buttons. The track channels may include an upper panel, legs extending downward from the upper panel and base panels parallel to the upper panel. The base panels may define a snap channel therebetween. The snap buttons may be received in the snap channels defined by the base panels to secure the track channel to the mounting site.

18 Claims, 28 Drawing Sheets

MULTIPLE LIGHT SYSTEMS

CROSS-REFERENCE TO RELATED APPLICATION

The present application is a continuation in part of my U.S. patent application Ser. No. 08/607,225 filed on Feb. 26, 1996, now U.S. Pat. No. 5,707,136 and entitled "IMPROVEMENTS IN MULTIPLE LIGHT SYSTEMS."

FIELD OF THE INVENTION

The invention relates generally to multiple light strings and, more particularly, but not by way of limitation, it relates to further improved apparatus for installation and handling of decorative light arrays.

DESCRIPTION OF THE PRIOR ART

There is prior art extending back over a long period of time that relates to light strings and apparatus for mounting various types of indoor and outdoor decorative displays. An early U.S. Pat. No. 3,189,310 discloses an outside light holder for Christmas lights that consists of a cylindrical holder that may be fastened to a building roof or facia location to hold an individual Christmas light socket. U.S. Pat. No. 3,204,090 shows another early form of light string support wherein a channel member is adapted for mounting of a string of spaced Christmas lights, and the channel member is fitted with a hook edge for the purpose of suspending the channel from the front of residential guttering thereby to display light pattern along the roof eave line. U.S. Pat. No. 3,540,687 teaches an individual light socket retaining means that consists of a base element for mounting to a house or similar structure and includes a clip-type light socket holder that is attachable to the base element. A plurality of such base element/clip holders may be attached to the residential structure in order to mount a string of decorative lights

SUMMARY OF THE INVENTION

The present invention relates to improvement components for a decorative light installation. Multiple electric light strings are designed for insertion and seizure along a light track channel of designated length. The track channel includes a snap channel disposed centrally along the bottom of the track channel for pressure fixture to a molded snap button that may be permanently secured to a mounting site such as a residential roof or facia. A multiple of such track channels, clips and slideways are included herein, and such fixtures extend the design choices of individual components making up a light string array.

Also included is a faceted, translucent cover which may be referred to as a track cover or an illuminating cover. The cover, when attached to a mounting site, provides an enclosed, elongated space in which the string of lights may be disposed, and will cover the string of lights. The cover may be molded or extruded and may generally have a U shape.

Therefore, it is an object of the present invention to provide an alternative form of mounting track channels and accessories carrying a string of multiple light bulbs releasably positioned thereon.

It is also an object of the present invention to provide a storage rack that is interactively compatible for carrying a multiple of individual track channels with light strings for subsequent storage.

Finally, it is an object of the present invention to provide multiple light track channels and storage racks that are sturdy yet light in weight.

Other objects and advantages of the invention will be evident from the following detailed description when read in conjunction with the accompanying drawings that illustrate the invention.

BRIEF DESCRIPTION OF THE DRAWINGS

FIG. 8 illustrates in elevation a roof with right angle friction tab carrying track channel and light string;

FIG. 16 is a wireform yard stake for retaining a light string and track channel in horizontal attitude;

FIG. 26 is an end view in vertical elevation illustrating the manner of securing the light track assemblies and track channels onto the storage clip;

FIG. 28 is an exploded end view of the components of FIG. 27;

FIG. 29 is a partial side view in elevation showing the elements of FIG. 27 assembled;

FIG. 37 is an end view in elevation of the assembled components of an alternative embodiment of a mounting system of the present invention including an illumination cover, a track channel, a string of lights and a mounting base;

FIG. 38 is an end view in elevation of the components of an alternative embodiment of a mounting system of the present invention including an illumination cover including an integral bulb clamp attached to a mounting base;

FIGS. 42, 43, 44, 45 and 46 show alternative embodiments of track channels of the present invention along with alternative embodiments of mounting clips used to hold strings of lights in place along the track channels

DETAILED DESCRIPTION OF THE INVENTION

Figure 1:
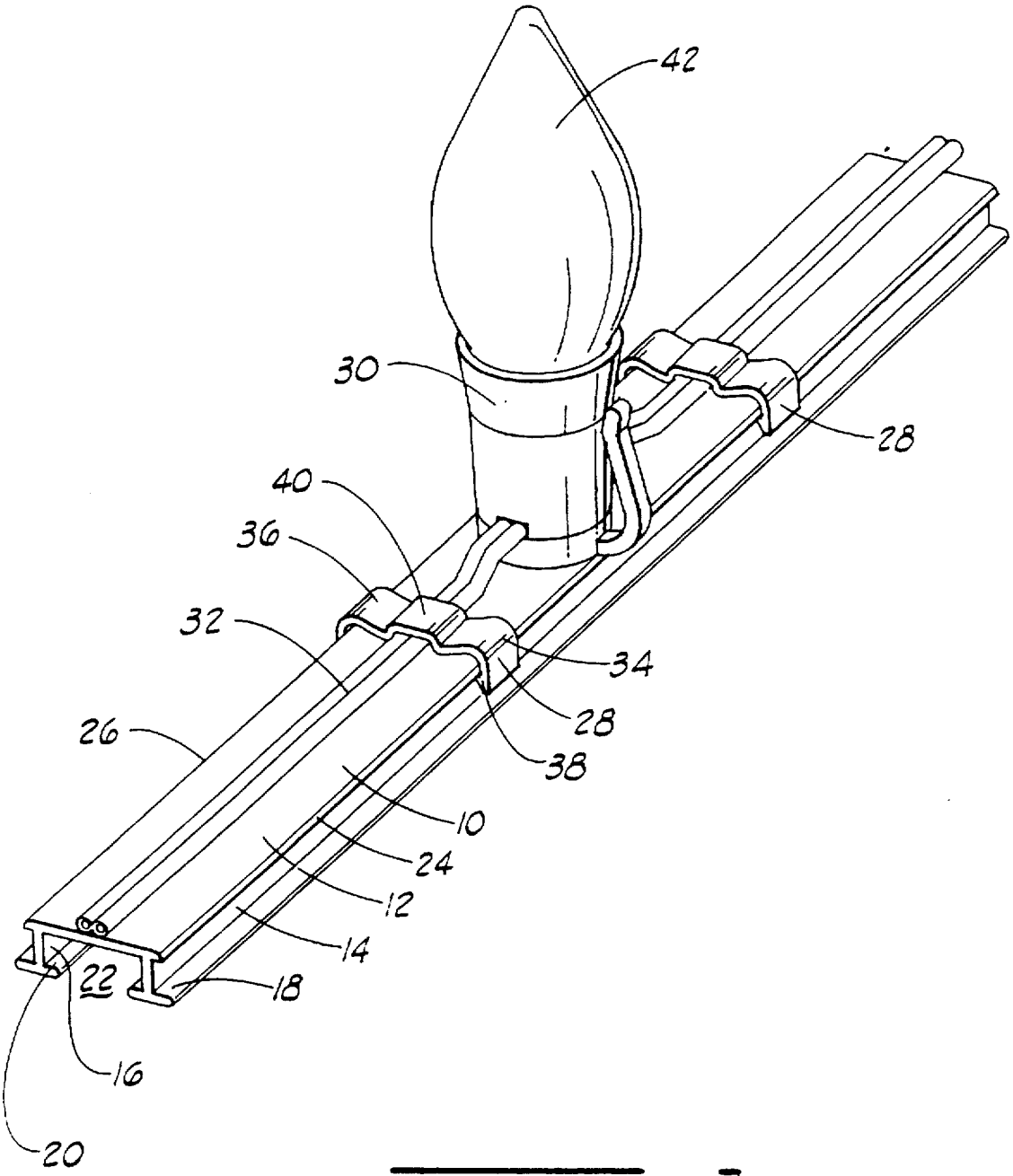
FIG. 1 is a perspective view of a section of track channel with light string attached.

FIG. 1 illustrates a modified form of track channel 10 that is formed as a flat upper panel 12 having opposite underside panels 14 and 16 with parallel, opposite side base panels 18 and 20 defining the slideway 22 therebetween. Opposite side flanges 24 and 26 of the upper panel 12 provide a gripping surface for each of clips 28 which hold the light sockets 30 and wire bundle 32 in central alignment upon the track channel 10.

The clips 28 are formed with opposite side shoulders 34 and 36 which terminate with a respective tooth flange 38 for gripping beneath the side flanges 24 and 26. A raised formation 40 at the center of clip 28 provides keeper space for the wire bundle 32, in this case a two-wire pair. Thus, an elongate section of track channel 10 may have secured thereon, by means of a plurality of clips 28, a section of light string carrying a plurality of light sockets 30 and bulbs 42. Typically, a six-foot section of track channel 10 may be adapted to carry on the order of eight sockets 30 arrayed on a wire bundle 32 by placing two clips 28 on opposite sides of each light socket 30 along the length of track channel 10. If additional lights exist in the string, then one or more additional track channels 10 may be secured to support the additional light socket length. While a two-wire pair is shown in support of the light array, it should be understood that the multiple wire arrays, such as the Oriental multi-wire light riggings, may also be operatively retained along a light channel 10 by means of the clips 28.

Figure 2:
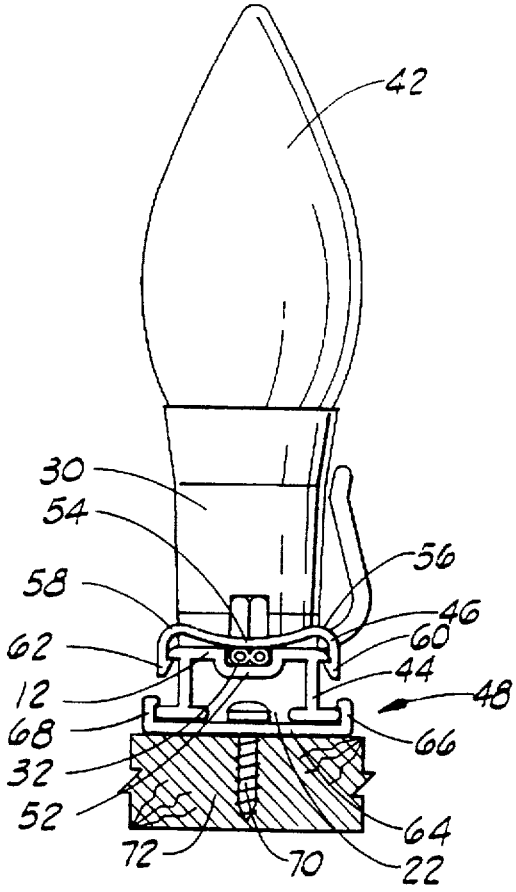
FIG. 2 is a view in vertical section of a track channel and light element affixed to a slide channel support structure.
Figure 3:
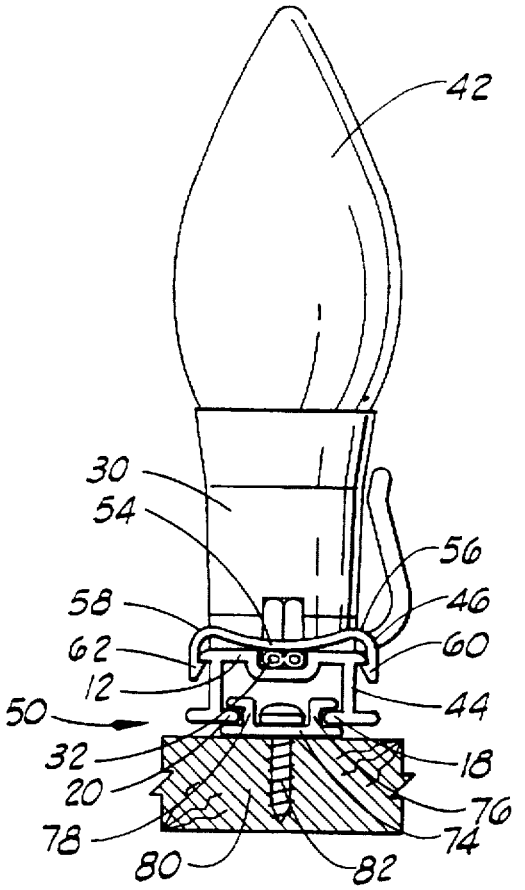
FIG. 3 is a view in vertical section of an alternative form of track section as affixed to an alternative form of slide channel.

FIGS. 2 and 3 illustrate an alternative form of track channel 44 and clip 46 as they may be retained by either a slide channel 48 or, alternatively, a slide channel 50. FIGS. 2 and 3 both illustrate a track channel 44 which is slightly different in that upper panel 12 is formed with a central groove 52 which carries the wire bundle 32 in recess. The clips 46 are then formed with a bowed center section 54, opposite side shoulders 56 and 58 which terminate in respective tooth flanges 60 and 62 to seize around the upper panel of track channel 44. In FIG. 2, a slide channel 64 having opposite side guide channels 66 and 68 is mounted by means of plural, spaced screw fasteners 70 to a mounting member 72. In FIG. 3, a slide guide 74 is formed with opposite side guide channels 76 and 78 which slidably receive the inner flange edges 20 and 18 of the track channel. The slide guide 74 is also secured to a mounting member 80 by means of a plurality of fasteners 82.

Figure 4:
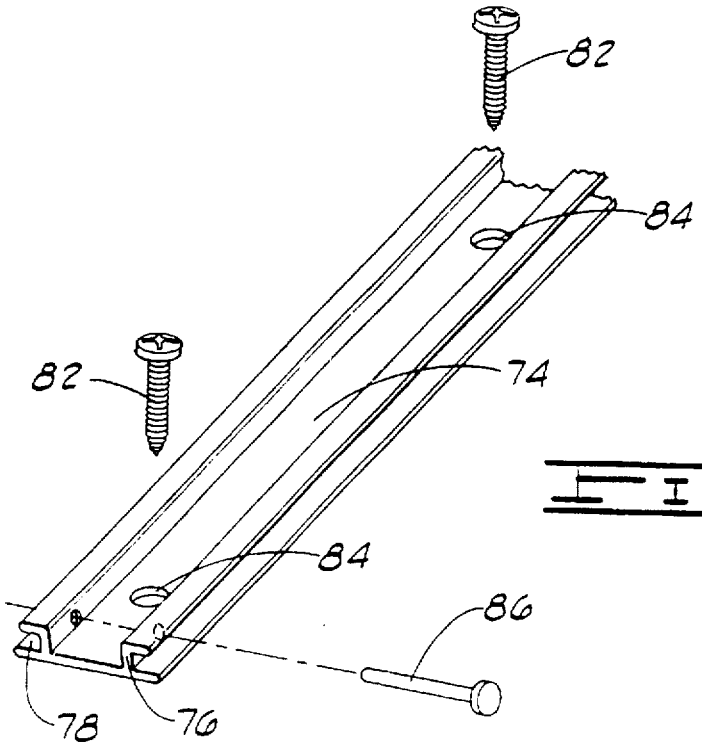
FIG. 4 is a perspective view of a section of slide channel with fasteners.
Figure 5:
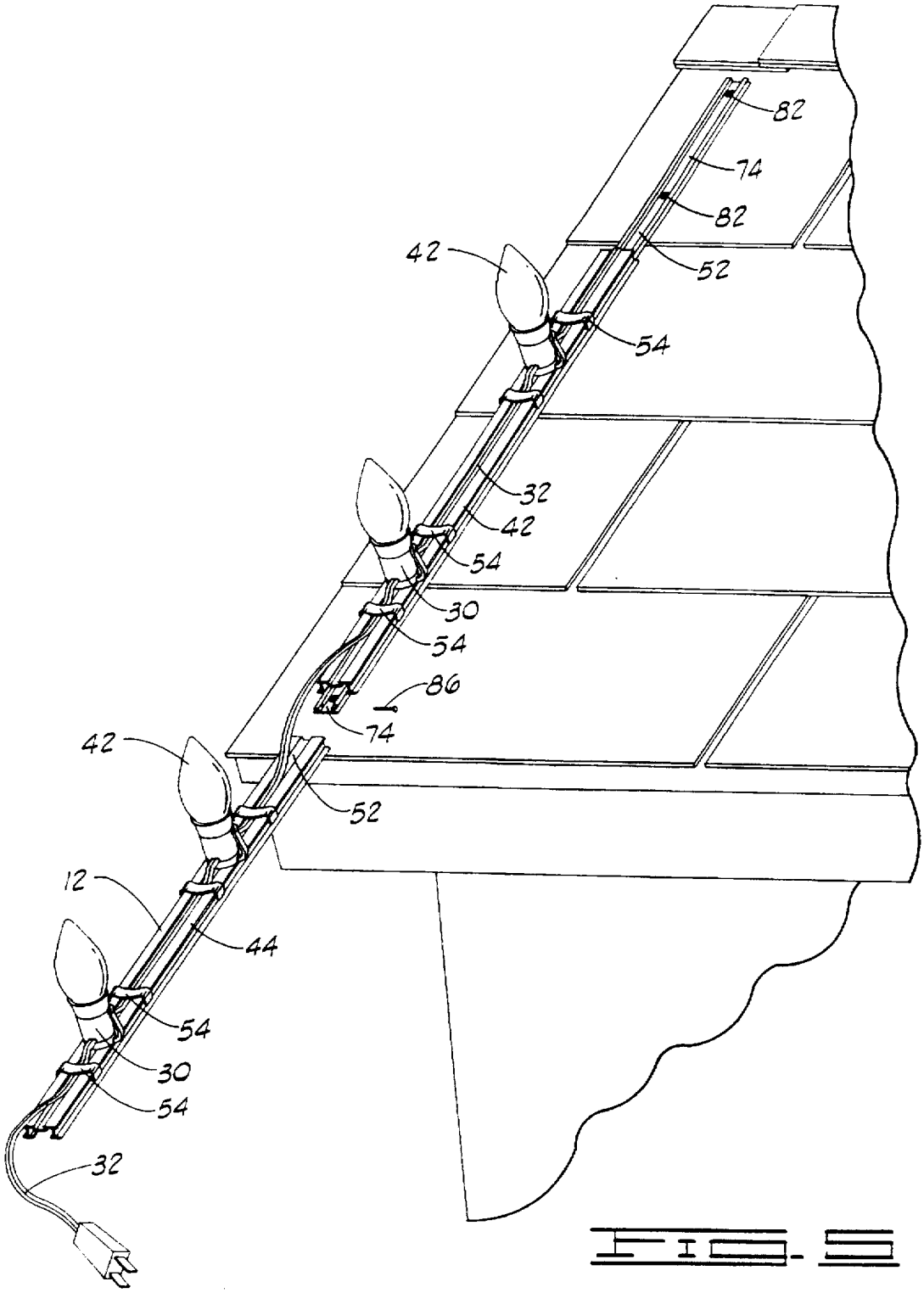
FIG. 5 illustrates the sliding placement of track channels with light string slidably disposed in a slide channel as affixed to roof structure.

FIGS. 4 and 5 illustrate the slide guide 74 in greater detail wherein it is utilized for roof installation. The slide guide 74 is secured to a rooftop in selected positioning by means of a plurality of screw fasteners 82 in holes 84 in a predesigned pattern. Then the assembled track light structure with sockets 30 and wire bundle 32 installed along the track channel 44 and secured with a plurality of clips 54 may be easily slid onto the slide guide 74 and into proper position along the roof structure. Once the track channel 44 has been positioned up along slide guide 74, a keeper pin 86 may be inserted horizontally through track channel 74 thereby to maintain the track channel in operative position. A plurality of such track assemblies may be pushed up the slide guide 74 as each track channel 44 serves to push the next track channel 44 section until the full complement of track channels 44 has been placed. Thus, such slide guide installed light tracks can be installed and removed without climbing on the roof.

Figure 6:
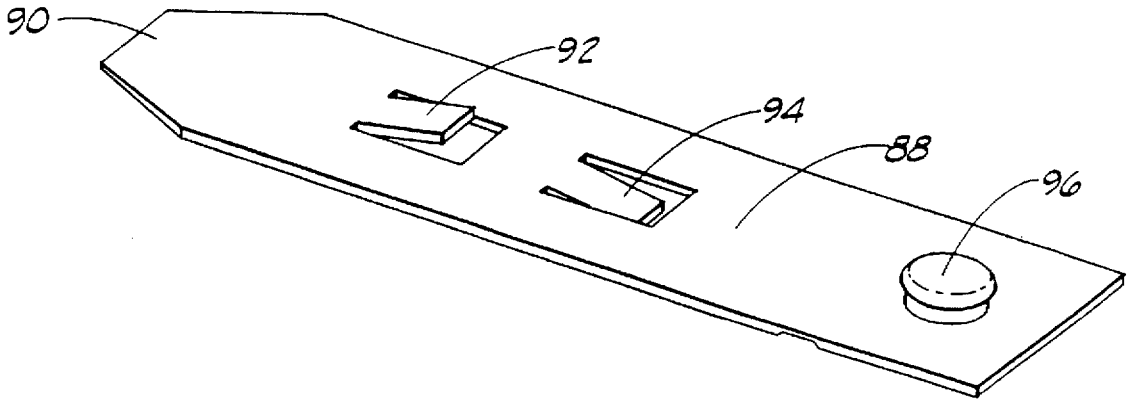
FIG. 6 is a perspective view of a friction tab for roof edge installation.
Figure 7:
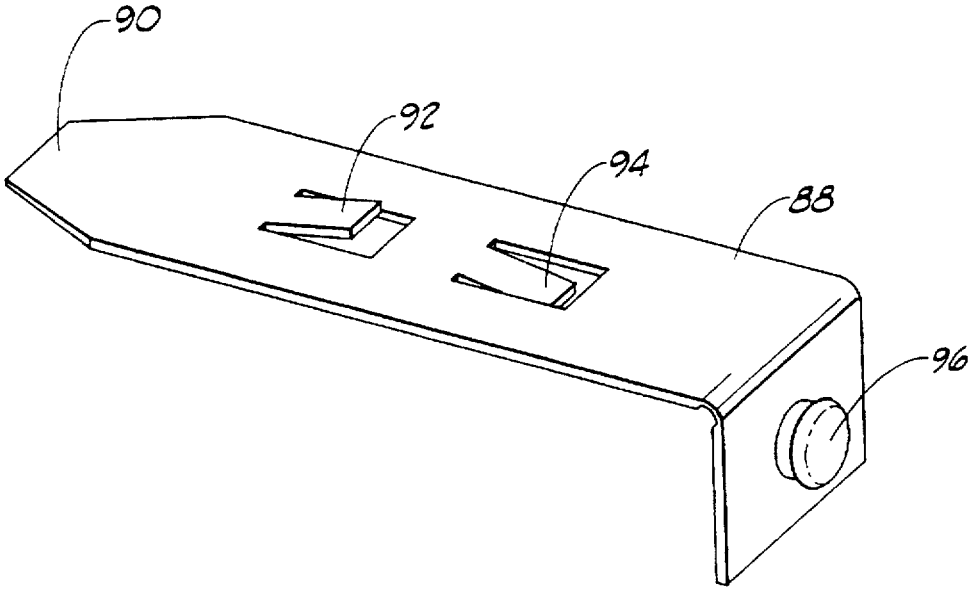
FIG. 7 is a perspective view of a right angle form of friction tab for roof edge installation.

FIGS. 6, 7 and 8 illustrate the manner whereby friction or shingle tabs may be utilized for the light track assembly. Thus, referring to FIG. 6, a flat shingle tab 88 may be formed of plastic or metal with a relatively sharpened upper edge 90 for insertion beneath the shingle structure and a pair of oppositely formed punch wedges 92 and 94 grip to secure the shingle tab 88 in position at roof edge. The shingle tab 88 includes a flange button 96 which is of a size to be secured to the underside of a track channel 44 (see FIG. 8). FIG. 7 illustrates the same shingle tab 88 as it is formed with a 90° bend at the lower end so that the securing button 96 supports the light string in a generally horizontal attitude. As shown in FIG. 8, the shingle tab 88 may be secured between the shingles 98 and roof panel 100 to extend the securing button 96 outward from the roof. A track channel 44 may then be arrayed along a plurality of such shingle tabs 88 as the track channel 44 flanges 20 and 18 (slideway 22) are snap-fit over the securing buttons 96 along the length of the predesignated pattern.

Figure 11:
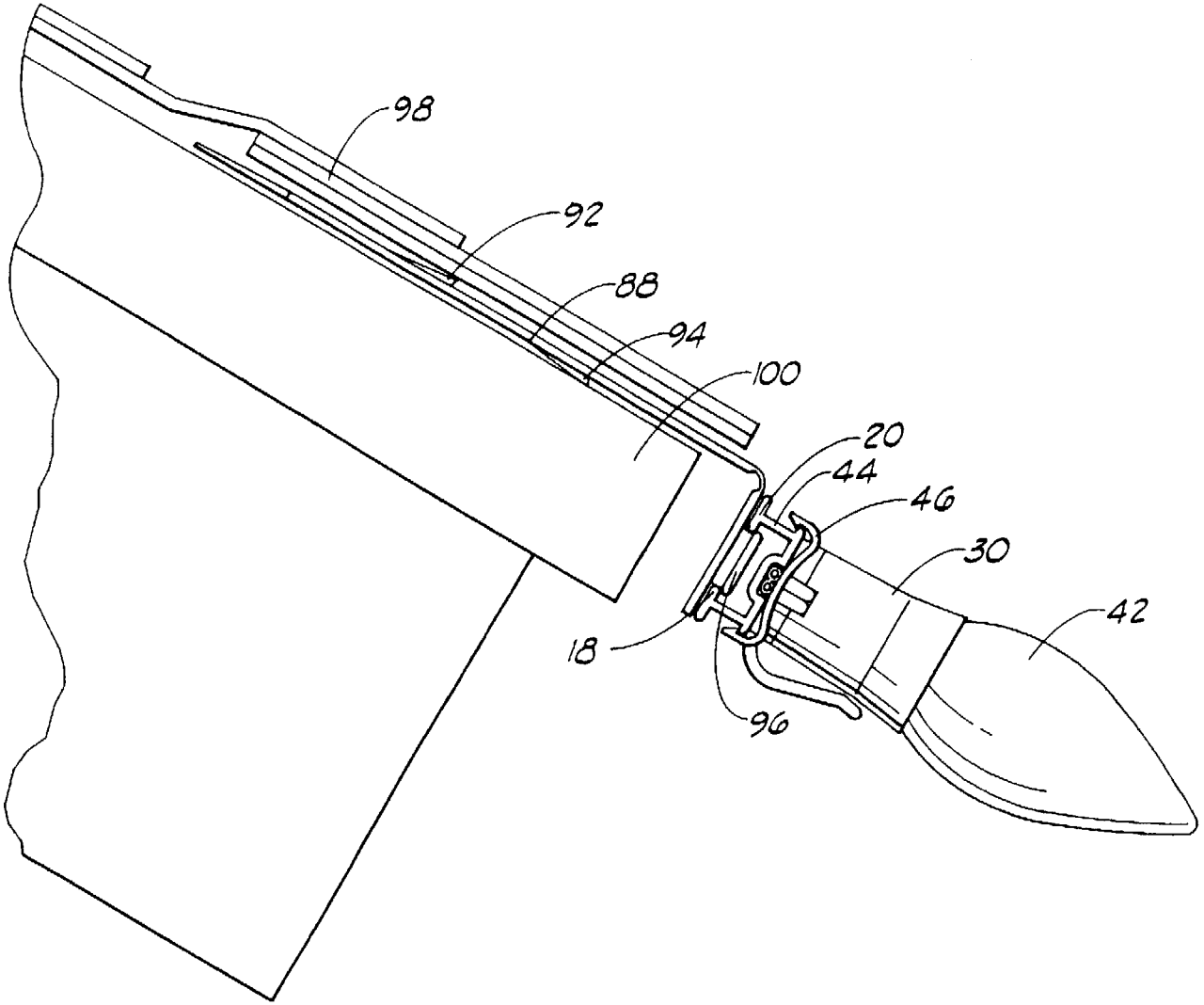
FIG. 11 is a view in vertical section of the gutter clip of FIG. 9 with light string secured on a plastic roof gutter.
Figure 9:
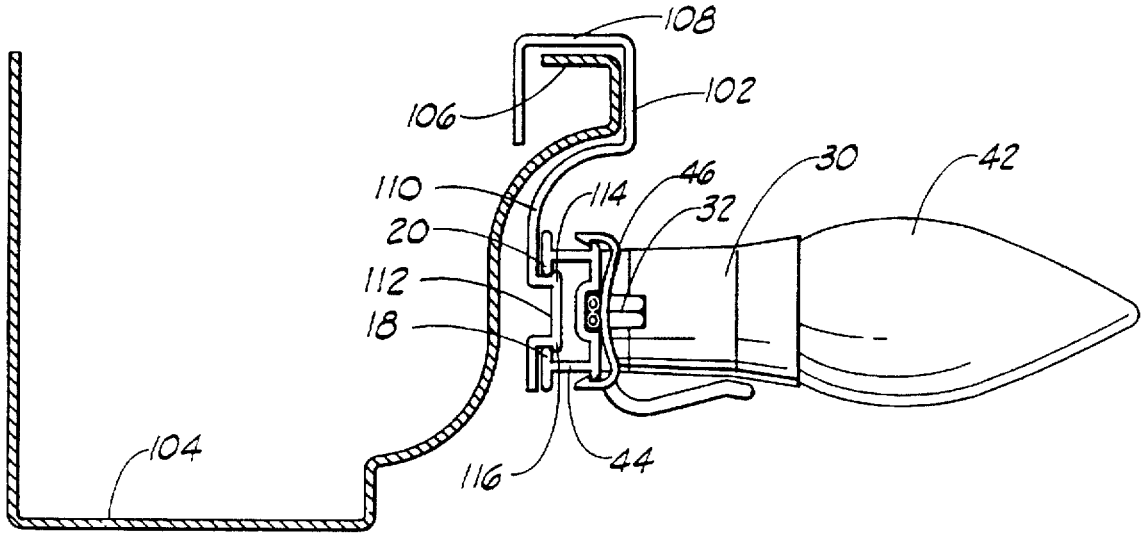
FIG. 9 is a view in section showing a gutter clip carrying channel and light string.
Figure 10:
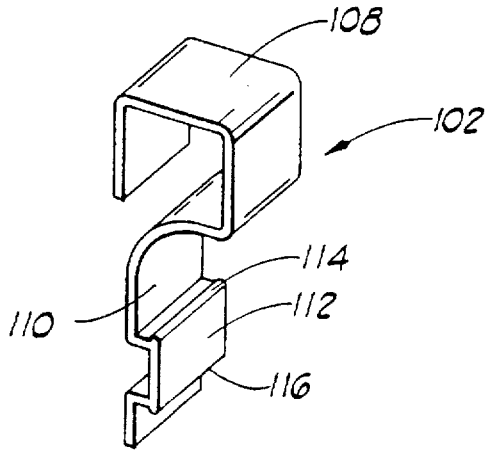
FIG. 10 is a perspective view of the gutter clip element of FIG. 9.
Figure 11:
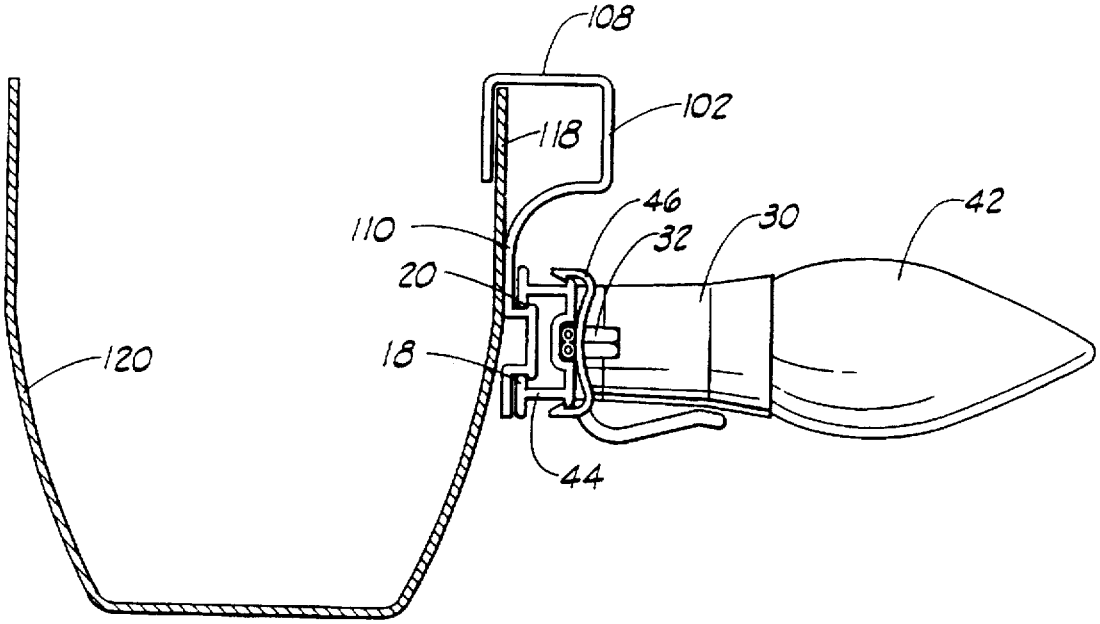

FIG. 9 illustrates a gutter clip 102 that may be connected to the front edge of a typical metal-type gutter 104 by affixture over the square, front edge 106. A plurality of gutter clips 102 may be arrayed along the gutter 104 to support a track channel 44 carrying a light string consisting of wire bundle 32, sockets 30 and bulbs 42. As shown in FIG. 10, the gutter clip 102 is formed to include a square upper hook structure 108 that is hooked over square structure 106 of gutter 104, and the lower part of gutter clip 102 curves down to a vertical panel 110 to form a button-like rail 112 having upper and lower flanges 114 and 116. The track channel flanges 20 and 18 (slideway 22; FIG. 1) may then be tightly received over the flanges 114 and 116 of rail 112. FIG. 11 illustrates the manner in which the gutter clip 102 may also connect over the front edge 118 of a typical plastic-type gutter 120. In this case, the top hook structure 108 of gutter clip 102 hangs over the front edge 118 of gutter 120 while the central portion of panel 110 is allowed to rest against the front of gutter 120.

Figure 12:
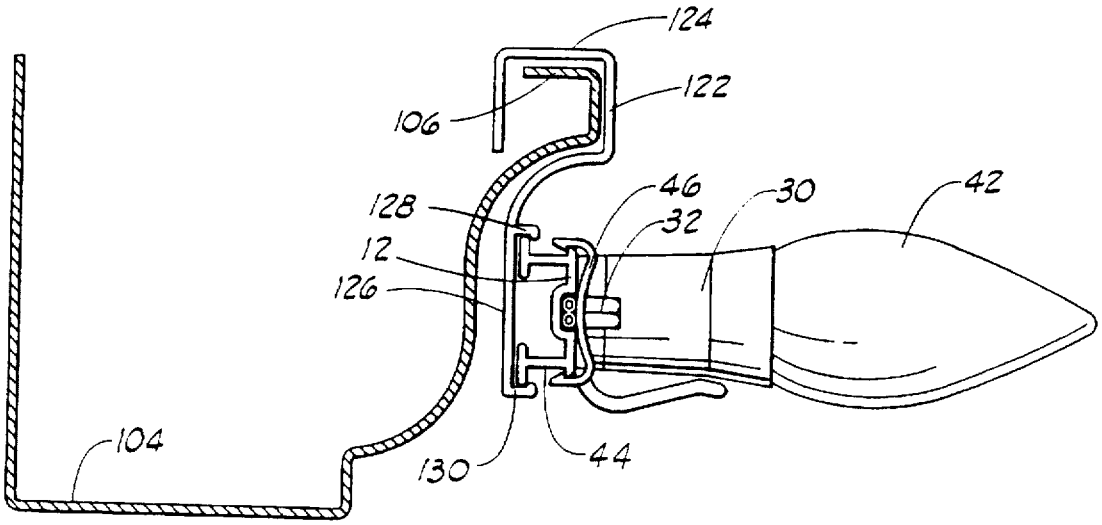
FIG. 12 is a view in section of yet another form of gutter clip as secured on metal-type roof gutter.
Figure 13:
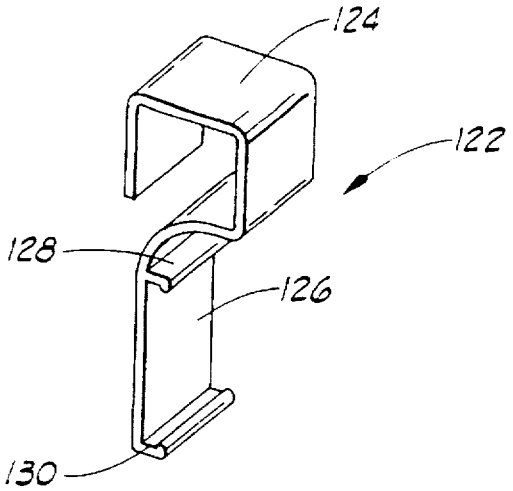
FIG. 13 is a perspective view of the gutter clip shown in FIG. 12.

FIG. 12 illustrates the manner in which a gutter clip 122 (FIG. 13) is adapted to hang over the front edge 106 of a metal-type gutter 104. Referring to FIG. 13, the alternative gutter clip 122 is also formed into a relatively square hook structure 124 which then extends into a vertical panel 126 having parallel upper and lower flanges 128 and 130 formed thereon. The flanges 128 and 130 form a slideway for receiving a track channel 44 (FIG. 12) therein as track channel 44 supports a light string array. A plurality of sockets 30 with bulbs 42 are retained along track channel 44 as a plurality of clips 46 are positioned across wire bundle 32 on each side of each socket 30.

Figure 14:
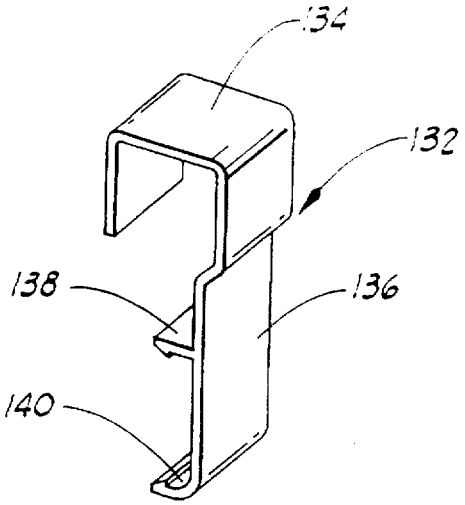
FIG. 14 is a perspective view of yet another type of gutter clip that is suitable for installation on metal-type or plastic type roof gutter.
Figure 15:
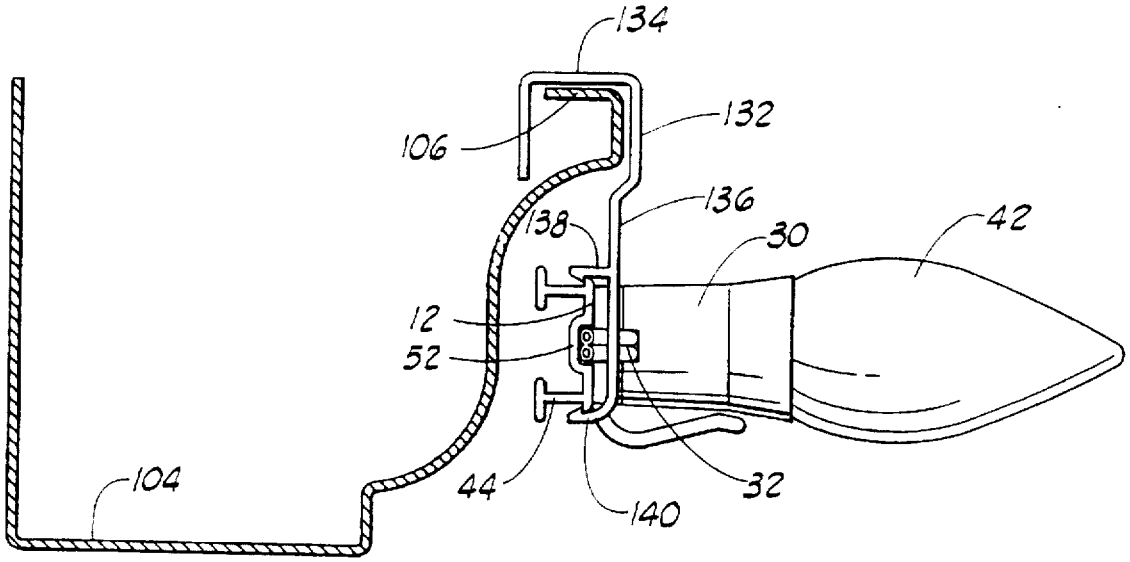
FIG. 15 is a view in vertical section of the gutter clip of FIG. 14 installed and carrying a light string.

FIG. 14 shows yet another alternative form of gutter clip 132 which is formed to have a square hook structure 134 at the upper end and is formed with a vertical panel 136 which carries opposed, parallel slide flanges 138 and 140 on the inner side, ice, the side of vertical panel 136 toward the hook structure 134. As shown in FIG. 15, a track channel 44 carrying a light string can be supported on the rearward side of vertical panel 136 by means of the parallel flanged channels 138 and 140. In this case, the gutter clips 132 each extend over the top panel 12 of the track channel 44 and serve to retain the wire bundle 32 within the channel 52. A plurality of such gutter clips 132 may be employed in sufficient number to provide support in retaining wire bundle 32 along the total length of light string.

Figure 17:
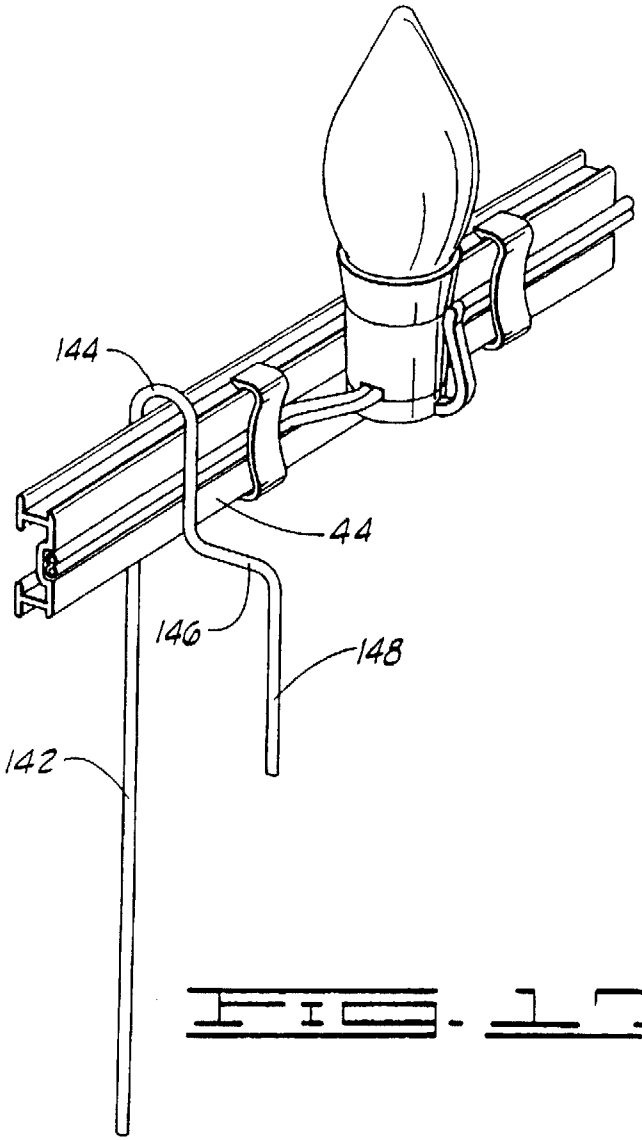
FIG. 17 is a perspective view of the wireform yard stake securing the light track channel in a side vertical attitude.
Figure 18:
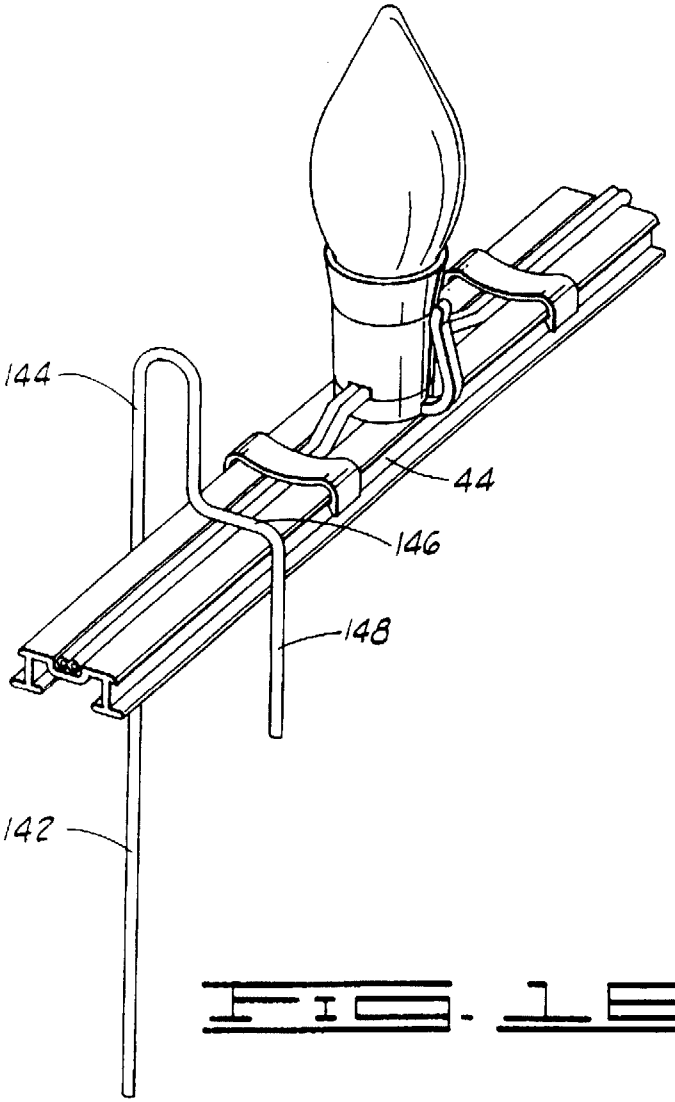
FIG. 18 is an idealized view in vertical section of the yard stake of FIG. 16.
Figure 18:
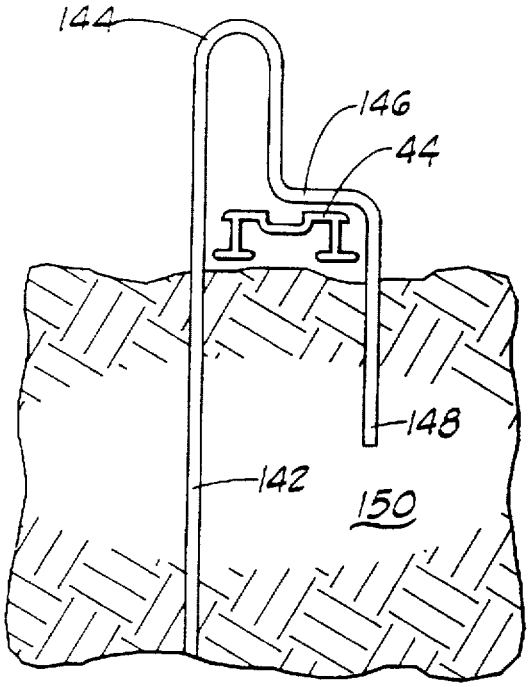
Figure 19:
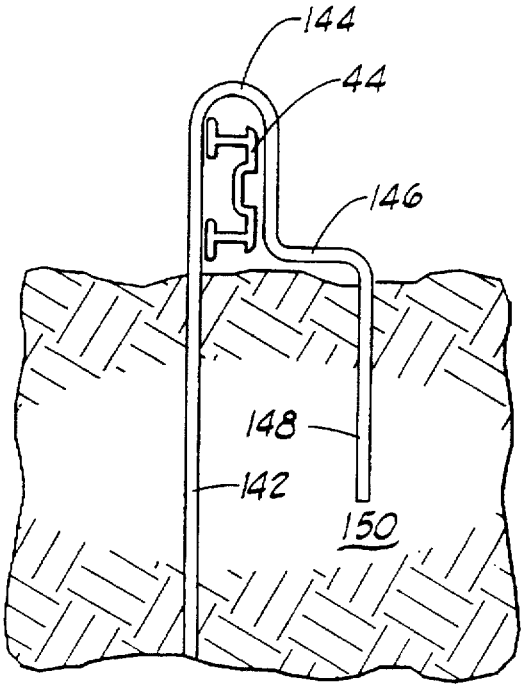
FIG. 19 is an idealized view in vertical section of the yard stake as deployed in FIG. 17.

FIGS. 16, 17, 18 and 19 illustrate the manner in which a wireform yard stake 142 may be utilized in forming certain decorative yard patterns. The yard stake 142 is formed with an upper loop 144 for staking a track channel 44 with light string in a sideways or vertical attitude as shown in FIGS. 17 and 19. And, yard stake 142 is further bent at right angles to form a sector 146 prior to return to parallel sector 148 which is stabilized in the earth 150. The horizontal sector 146 functions to pin the track channel 44 down flatwise as shown in FIGS. 16 and 18.

Figure 39:
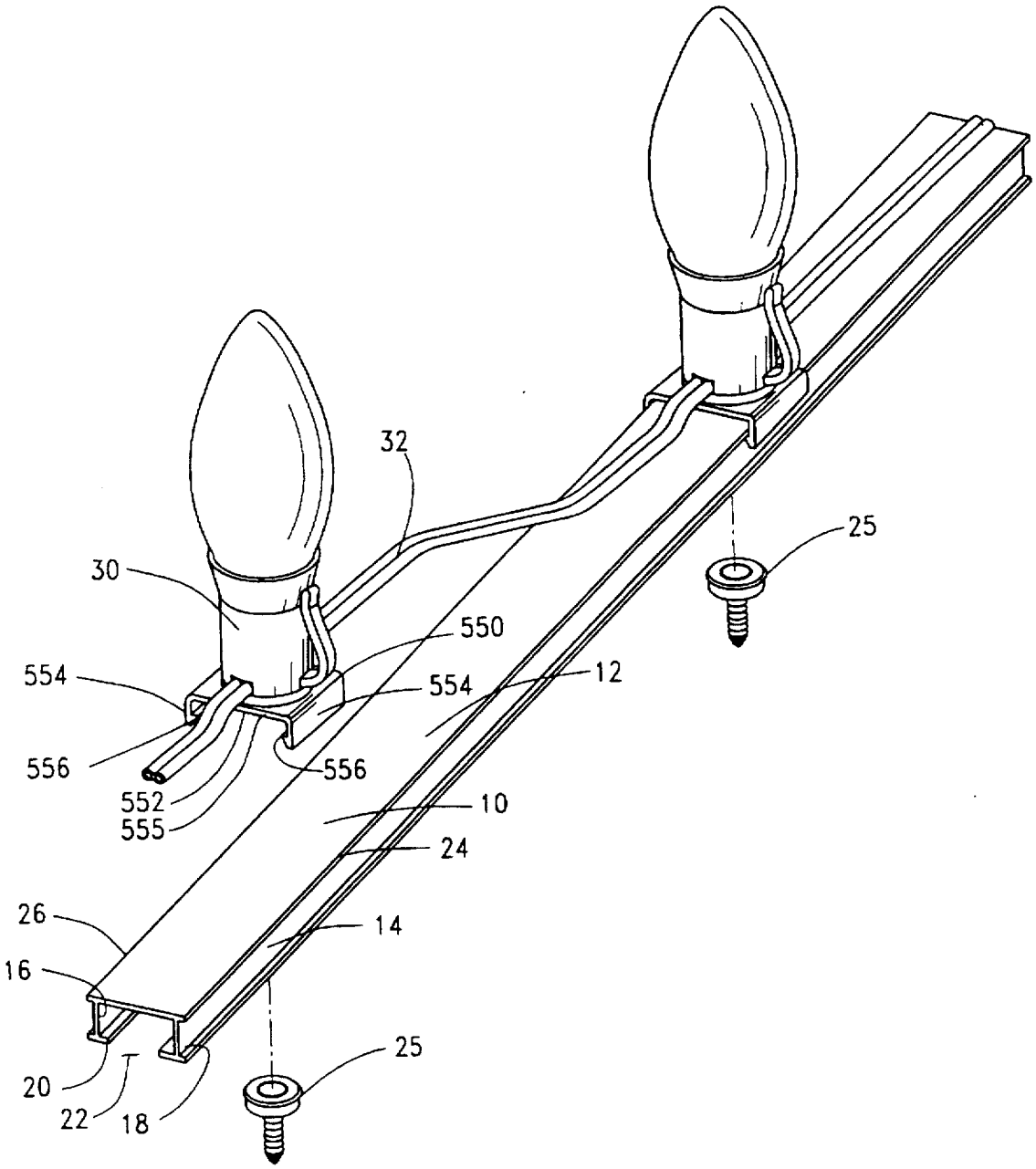
FIGS. 39, 40 and 41 show alternative embodiments of mounting clips used in connection with track channels of the present invention
Figure 40:
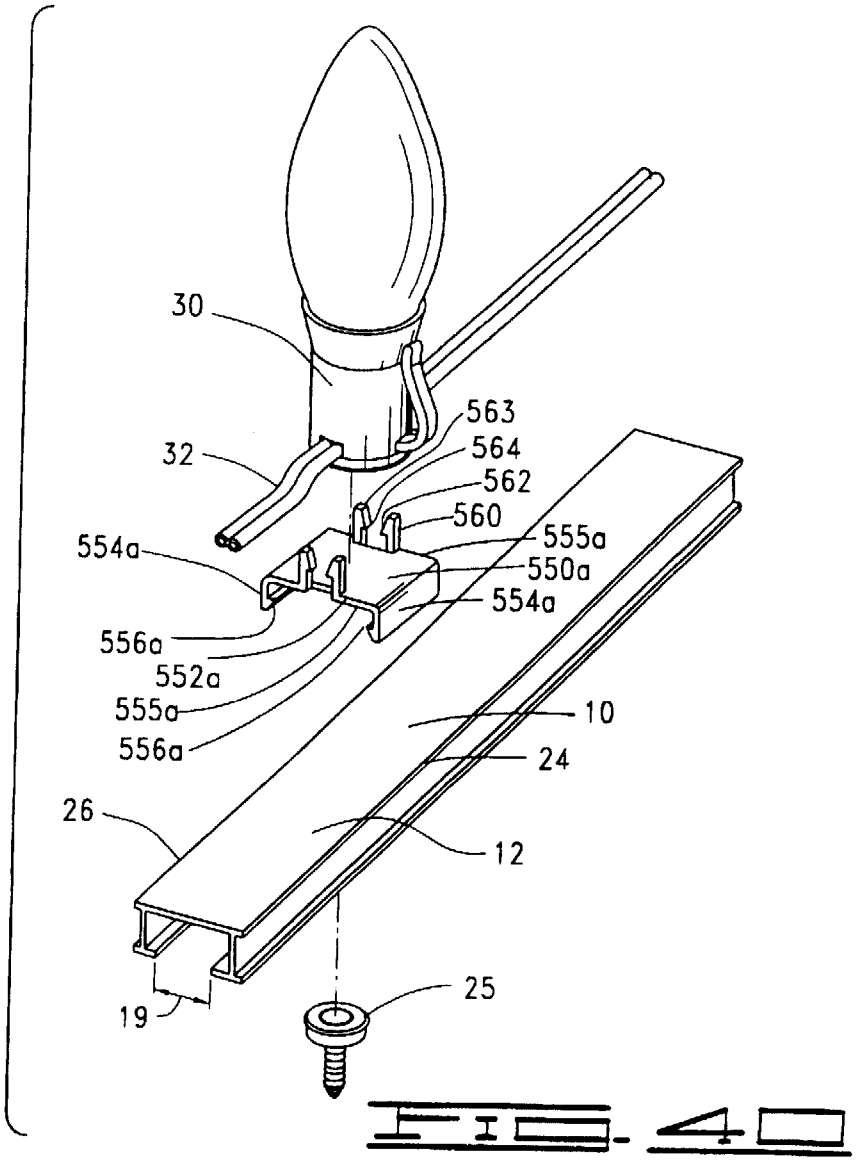
Figure 39A:
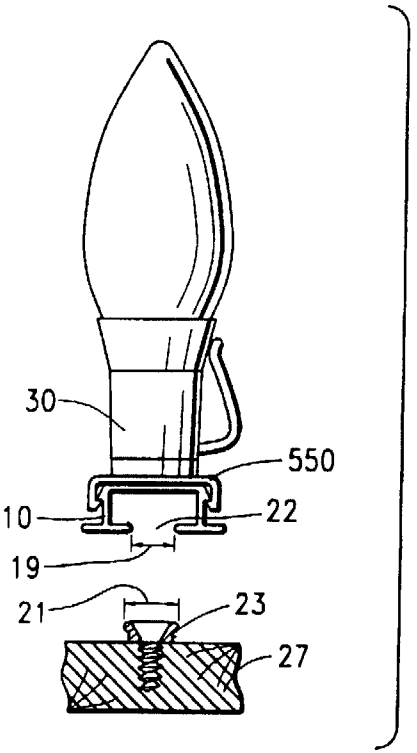
FIG. 39*a* shows an end view in elevation of the components of FIG. 39.
Figure 41:
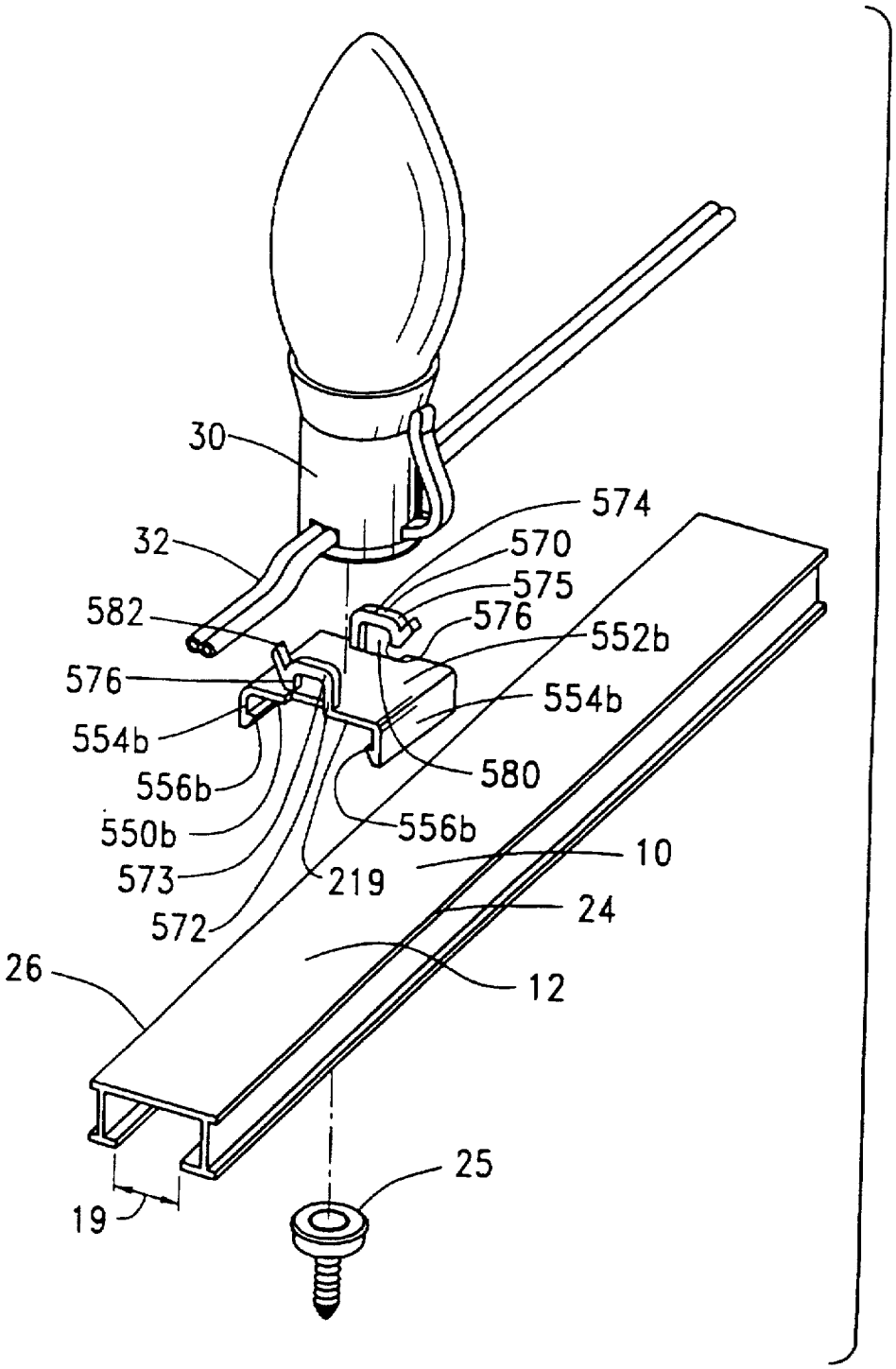

FIGS. 39, 40 and 41 show alternative embodiments of retainers or retaining clips which may be used in connection with track channel 10, which includes upper panel 12, underside panels, or support legs 14 and 16, and base panels 18 and 20 defining snap channel 22 therebetween. The width 19 of snap channel 22 is less than the diameter 21 of the head 23 of a snap button 25, so that snap button 25 will secure track channel 10 to a mounting base 27.

FIG. 39 shows a retainer or retaining clip 550 having a central portion 552, opposed side shoulders 554 extending downwardly therefrom, and outer, or side edges 555. Retaining clip 550 may be referred to as a mounting clip. A flange 556 extends inwardly from each downwardly extending side shoulder 554. When retainer 550 is snapped onto track channel 10, side shoulders 554 will flex outwardly until flanges 556 are received beneath side flanges 24 and 26 of track channel 10. Side shoulders 554 will then flex inwardly and flanges 556 will grip beneath side flanges 24 and 26 to hold the light string in place along track channel 10. As shown in FIG. 39, retaining clip 550 may be attached to the base of socket 30 and, if desired, may be integrally molded therewith.

FIGS. 40 and 41 show alternative embodiments of mounting or retaining clips similar to retaining clip 550. FIG. 40 shows a mounting clip 550A having center portion 552A and downwardly extending side shoulders 554A. Flanges 556A extend inwardly at the lower end of side shoulders 554A so that clip 550A will grip beneath side flanges 24 and 26 of track channel 10. Mounting clip 550A further includes wire bundle retainers 560 extending upwardly from the outer edges 555A of center portion 552A. Wire bundle retainers 560 may comprise a pair of opposed upwardly extending legs 562 having opposed inwardly extending tangs 564 defined at the upper ends 563 thereof so that wire bundle 32 may be forced downwardly between legs 562 so that it will be received beneath tangs 564 which will hold wire bundle 32 in place along track channel 10. Retaining clip 550A may include two wire clips 560 with one each disposed at the outer edges thereof so that the bulb socket may rest on center portion 552A between two wire bundle retainers 560. If desired, the base of bulb socket 30 may also be attached to center portion 552A.

FIG. 41 shows mounting clip 550B having center portion 552B, and downwardly extending side shoulders 554B having flanges 556B extending inwardly therefrom. Mounting clip 550B includes wire bundle retainers 570 extending upwardly from the outer edges of 555B thereof. Wire bundle retainers or wire clips 570 each include a support leg 572 extending upwardly from center portion 552B at the outer edges 555B thereof. Wire retainer 570 further includes a top portion 574 connected to an upper end 573 of support leg 572 and extending at a right angle therefrom. Top portion 574 may be substantially parallel to central portion 552B of mounting clip 550B. A retaining leg 576 extends downwardly from an outer end 575 of top portion 574. A space 580 is defined between top portion 574 and center portion 552B of wire clip 570. As is obvious in FIG. 41, wire bundle 32 may be placed beneath top portion 574 and held in place by retaining leg 576. Space 580 may be such that wire retainer 570 must be flexed upwardly so that wire bundle 32 may be received beneath top portion 574. Wire retainer 570 can then be released and retaining leg 576 will capture wire bundle 32 thus holding the wire bundle and the string of lights in place. Wire retainer 570 may include a handle portion 582 which may be grasped to flex the wire bundle retainer and allow wire bundle 32 to be received therein. Handle portion 582 may be attached to and extend from retaining leg 576.

Figure 42A:
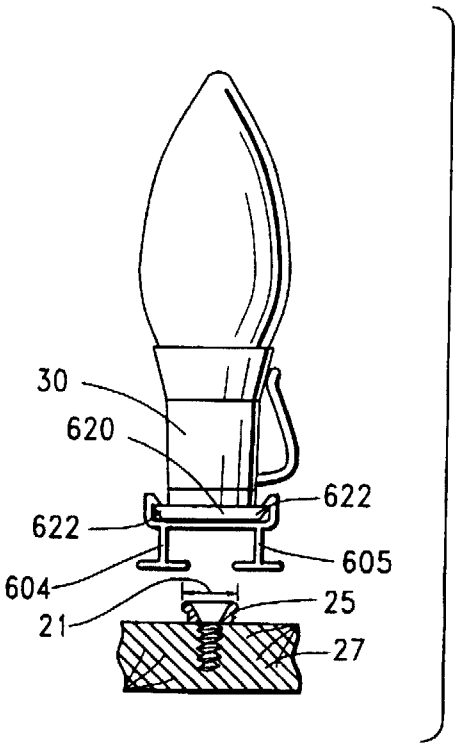
FIG. 42*a* shows an end view in elevation of the components of FIG. 42.
Figure 42B:
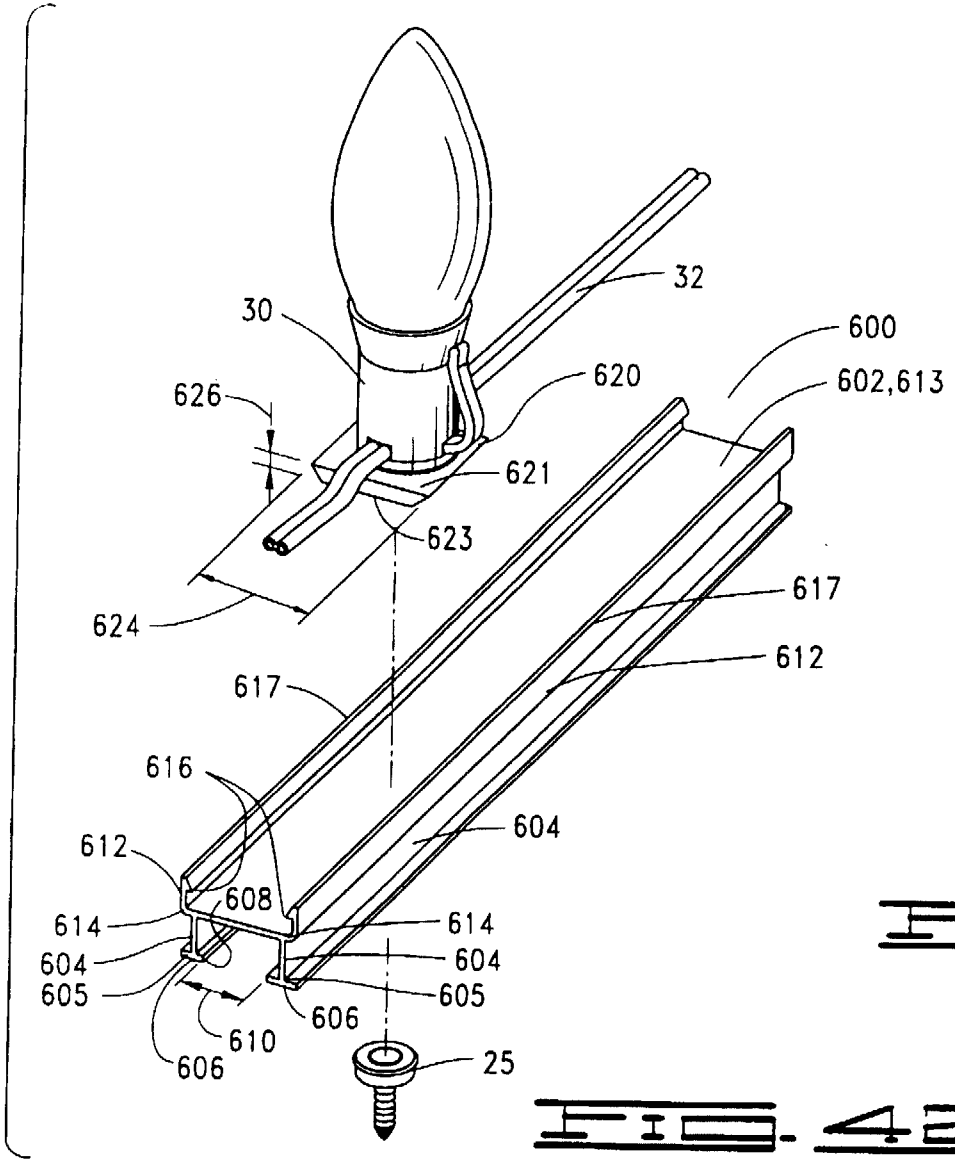
Figure 43:
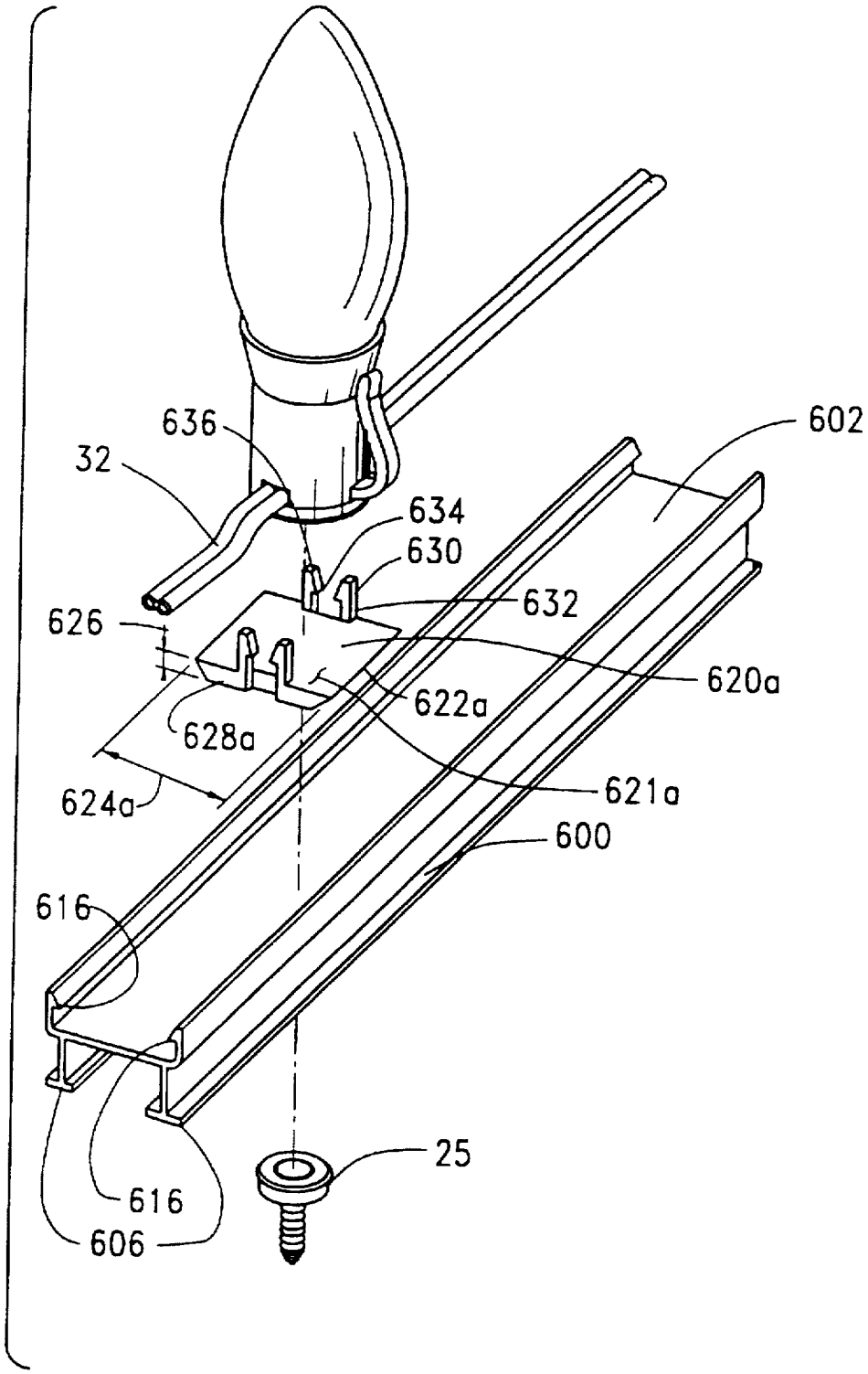
Figure 44:
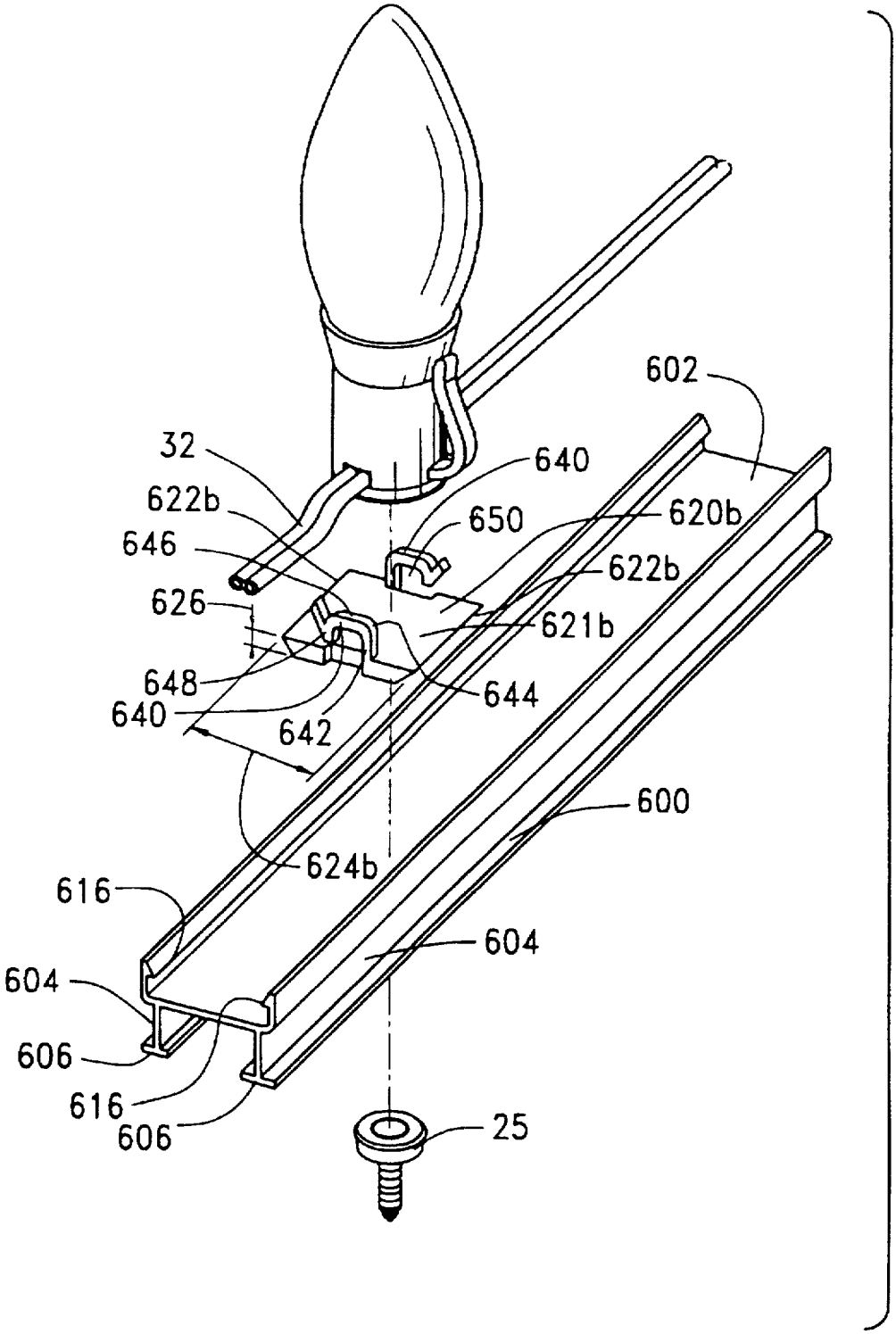

FIGS. 42–44 show alternative embodiments of a track channel and retaining clips used therewith. FIG. 42 shows a track channel 600 having an upper panel 602 and spaced underside panels or support legs 604 extending downwardly therefrom. Support legs 604 are preferably parallel support legs. A base panel 606 is attached to the lower end 605 of each underside panel 604. Base panels 606 define a slideway or snap channel 608 therebetween having a width 610. Width 610 is less than outer diameter 21 of snap buttons 25 secured to mounting base 27 so that snap buttons 25 may be utilized to secure track channel 600 thereto. Upper panel 602 includes a central portion 613 having a pair of opposed retaining legs 612 extending upwardly from the outer edges 614 thereof. Flanges 616 extend inwardly at the upper end 617 of upwardly extending retaining legs 612.

The embodiment of FIG. 42 includes a mounting clip or retaining clip 620 which may also be referred to as a lamp base 620. Mounting clip 620 is wider at an upper surface 621 thereof than at a lower surface 623 thereof so that mounting clip 620 defines flanges 622 having a width 624 therebetween. Mounting clip 620 has a thickness 626 such that mounting clip 620 may be pressed downwardly until flanges 622 of clip 620 are received beneath flanges 616. The width between flanges 616 is less than width 624 so that once the mounting clip is received beneath flanges 616, it will be held in place thereby. The lamp base 620 may be attached in any manner to the base of lamp socket 30 and, if desired, may be integrally molded therewith.

FIGS. 43 and 44 show alternative embodiments of a mounting clip to be used in connection with a track channel 600. Shown in FIG. 43 is a mounting clip or lamp base 620A substantially similar to mounting clip 620 having an upper surface 621A, flanges 622A with a width 624A therebetween and a thickness 626A. Mounting clip 620A includes wire bundle retainers, or wire clips 630 extending upwardly from the opposed edges 628A therefrom Wire bundle retainers 630 may comprise a pair of opposed legs 632 extending upwardly from upper surface 621A. Legs 632 may include tangs 634 extending inwardly from the upper ends 636 thereof. Wire bundle 32 may be pressed downward between tangs 634 and will be received between legs 632 beneath tangs 634 so that wire bundle 32 is held in place along track channel 600.

Mounting clip 620B, which is substantially similar to mounting clip 620, is shown in FIG. 44. Mounting clip 620B includes an upper surface 621B, flanges 622B having a width 624B therebetween and a thickness 626B. Mounting clip 620B and the features thereof are essentially identical to mounting clip 620 except that mounting clip 620B includes a wire bundle retainer 640. Wire bundle retainers 640 each may include a support leg 642 extending upwardly from upper surface 621B Wire bundle retainer 640 further includes a top portion 646 connected to an upper end 644 of support leg 642 and extending at a right angle therefrom. Top portion 646 may thus be substantially parallel to upper surface 621B. A retaining leg 648 extends downwardly from an outer end 649 of top portion 646. A space 650 is defined between top portion 646 and upper surface 621B. Wire bundle 32 may be placed beneath top portion 646 and held in place by retaining leg 648. Wire retainer 640 may include a handle portion 652 which may be grasped to allow the wire retainer to be flexed so that wire bundle 32 may be placed beneath top portion 646. The retaining leg 648 will capture wire bundle 32 and hold wire bundle 32 in space 650 thereby attaching the string of lights to the track channel. Retaining clips 620A and 620B thus provide alternative means of attachment to the lamp base with the lamp wire bundle, as opposed to other methods of attachment of lamp bases 620, 620A and 620B such as integral molding or other attachment means.

Figure 45:
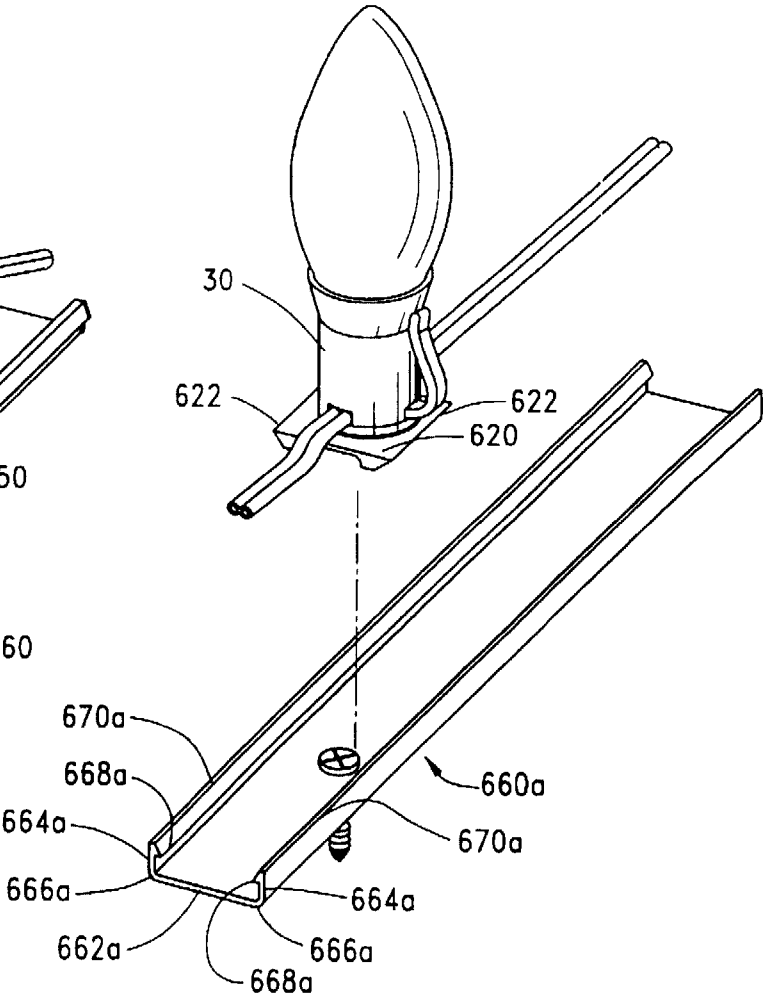
Figure 45:
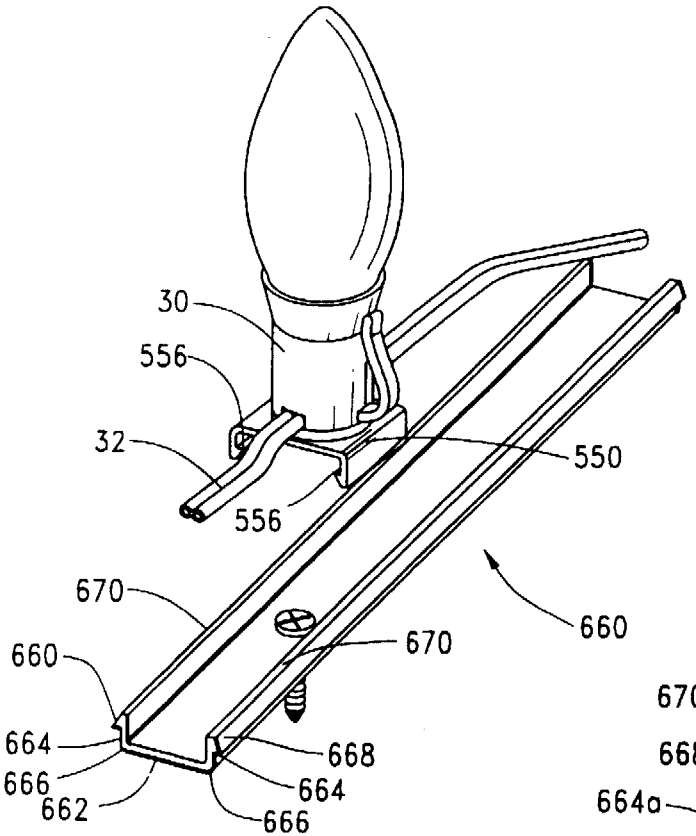

FIG. 45 shows a track channel 660 used in connection with the retaining clip 550 mounted to or integrally formed with the base of a lamp socket 30. Track channel 660 includes a substantially flat base panel 662 which may be connected, permanently if desired, to a mounting base with screws or other fasteners. A pair of retaining legs 664 extend upwardly from the outer edges 666 of base panel 662. A pair of flanges 668 extend outwardly from the upper end 670 of retaining legs, or shoulders 664. Retaining clip 550 may be snapped downward over track channel 660 so that flanges 556 on clip 550 are received beneath flanges 668 thereby holding bulb sockets 30 in place along track channel 660.

FIG. 46 shows a track channel 660A which is similar to track channel 660 but which can be used in connection with a retaining clip 620. The features of track channel 660A are identical to those of track channel 660 with the exception that track channel 660A has flanges 668A extending inwardly from the upper ends 670A of retaining legs 664A whereas the flanges at the upper end 670 of the shoulders 664 on track channel 660 extend outwardly Mounting clip, or lamp base 620 attached to or integrally formed with a bulb socket 30 may be pressed downward into track channel 660A until the flanges 622 defined thereon are received beneath flanges 668A thereby holding retaining clip or lamp base 620 and thus bulb sockets 30 in place along track channel 660A.

Figure 20:
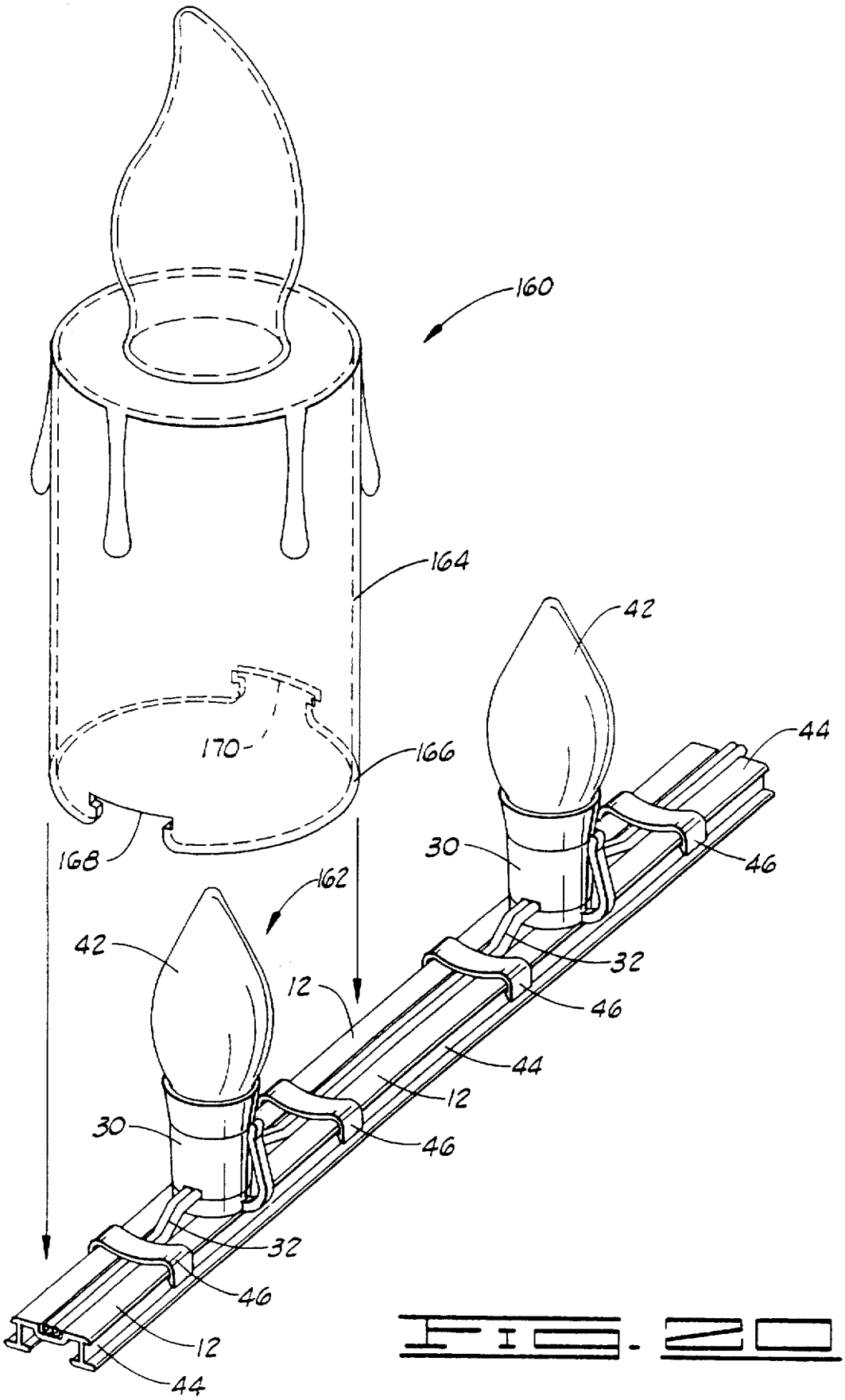
FIG. 20 is a perspective view in exploded form of an illuminated ornament that may be retained on the light track channel.
Figure 22:
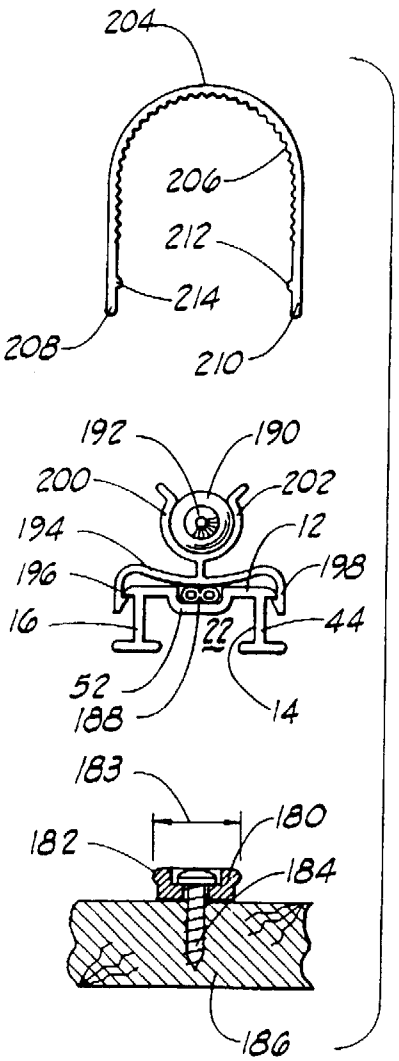
FIG. 22 is an exploded end view of the components of FIG. 21.
Figure 21:
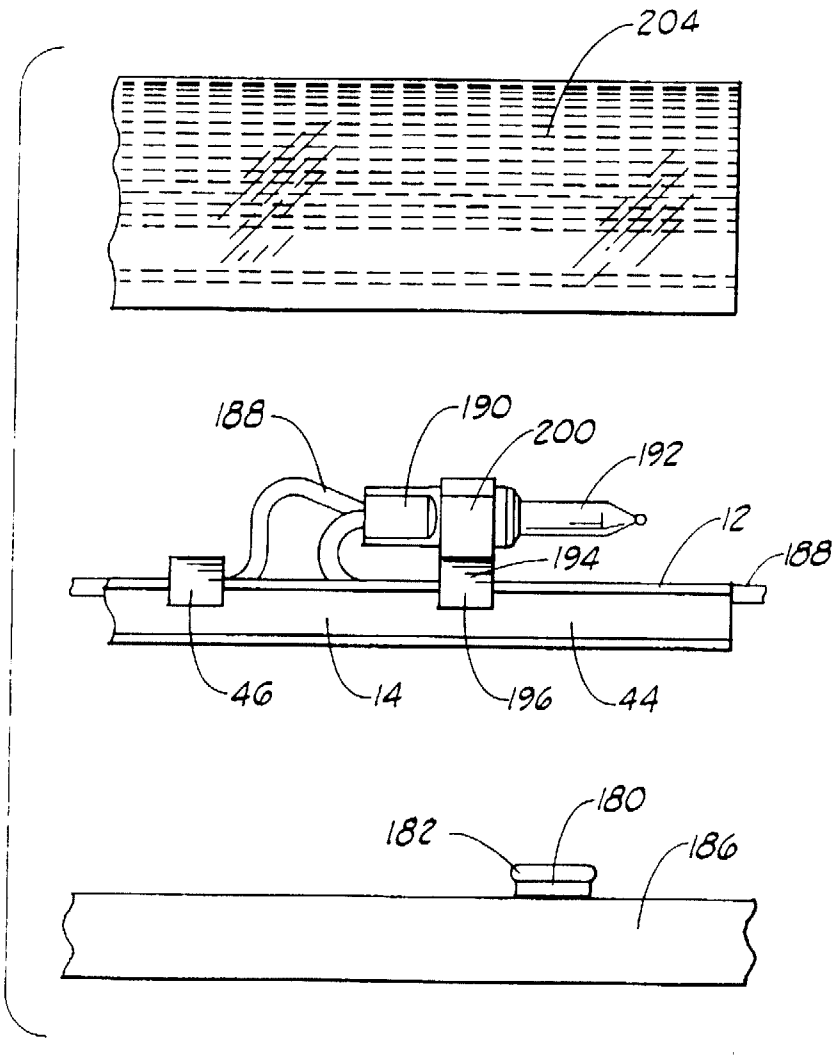
FIG. 21 is an exploded view in side elevation of a base member, track channel with light string and illumination cover of an architectural light display.

FIG. 20 illustrates a decorative accoutrement that may be utilized in combination with track channel light assemblies of the present type. An ornament 160 may be formed from suitable plastic in clear or translucent configuration that is large enough to envelop a single socket and lamp assembly 162. The ornament 160 is formed with the generally rounded lower portion 164 having a bottom rim 166 with opposed cut out portions 168 and 170 which are formed for locking engagement over the top panel 12 of track channel 44. The illuminated ornaments simply snap onto the light tracks while enveloping the lamps 42 to provide a glowing ornamental object. Many different holiday designs are possible such as Santa configurations, snowmen, candles, pumpkins, etc. It is contemplated that many unique designs and combinations will be developed.

FIGS. 21, 22, 23 and 24 relate to an alternative track lighting system including a translucent cover for permanent architectural installation either indoors or outdoors such as around patios or cabanas. Referring to the exploded views of FIGS. 21 and 22, the system utilizes snap buttons 180 having an upper interfering bead 182 with an outer diameter 183 and being secured by screw fastener 184 to a mounting base 186. The system utilizes the same type of track channel 44 having upper panel 12 with opposite side panels 14 and 16 and central channel 52, while the opposite side panels 14 and 16 define a snap channel 22 therebetween.

The Oriental type decorative lights having interconnecting wires 188, sockets 190 and lamp bulbs 192 are supported by means of bulb clamps 194 having opposite side vertical tangs 196 and 198 for gripping the opposite side flanges of top panel 12 of track channel 44. The track clip 194 includes a central formation extending upward therefrom and defining opposed clamp flanges 200 and 202 which seize and hold the socket 190 in a horizontal position relative to the track channel 44. The channel clamp 194 functions to retain the wire bundle 188 down within the channel 52 of track channel 44 as well as to support the socket 190. The wire bundle 188 is also suppressed into channel 52 by means of additional clips 46 disposed as needed along the track channel 44.

Figure 23:
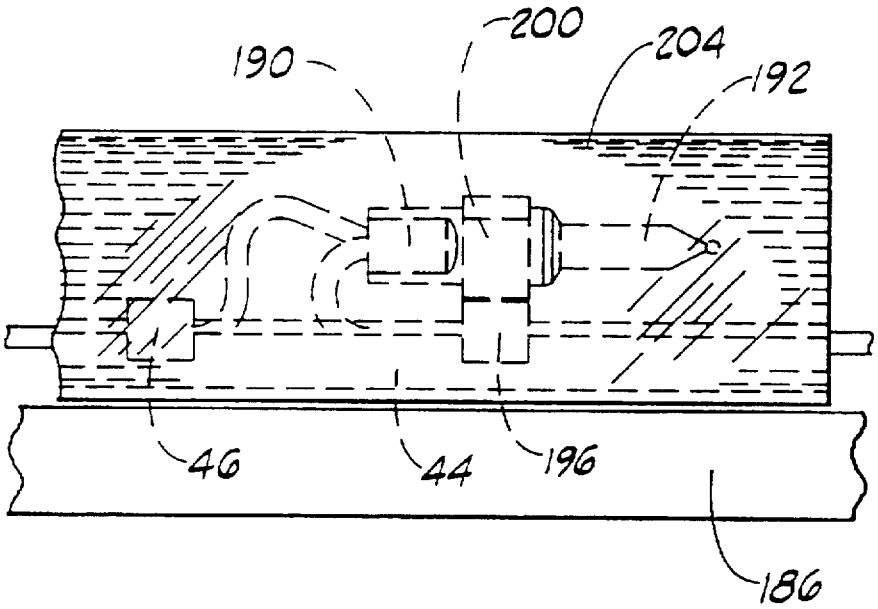
FIG. 23 is a partial side view in elevation showing the elements of FIG. 21 in assembled form.
Figure 24:
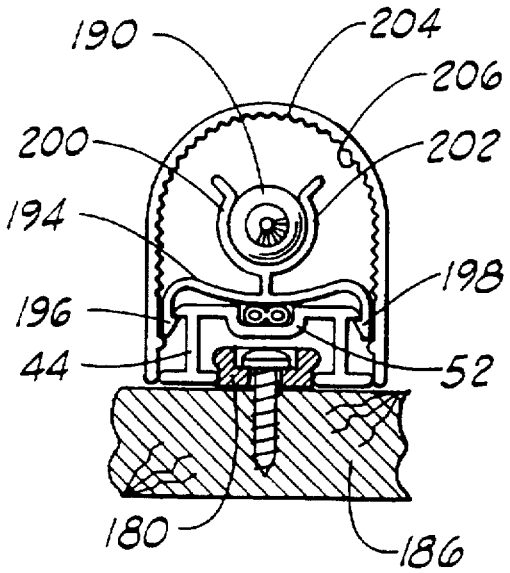
FIG. 24 is an end view in elevation of the components of FIG. 23.

The entire track channel 44 and light string can be covered by an extruded translucent track cover 204. Track cover 204 may be molded or extruded as a U-shaped formation being grooved for faceted lens effect on the inner side 206 while terminating at parallel side ends 208 and 210. A pair of opposed interfering beads 212 and 214 are formed along the inner edge of translucent cover 204 for the purpose of providing interfering or gripping affixture when assembled. FIGS. 23 and 24 illustrate the track lighting system when fully assembled. It should be understood that the light mounting clip 194 may be connected to a track channel 44 which, in turn, is connected to a mounting button or other slide channel; or, the lamp mounting clip 194 may be connected directly to a section of slide guide 74 which is mounted by screw fasteners.

As is apparent from the drawings, translucent cover 204 is affixed to mounting base 186 with fasteners 184 and snap buttons 180. Translucent cover 204, when affixed to mounting base 186 provides an elongated, enclosed space for the placement of the string of lights 188. A number of other similar type arrangements are shown in the alternative embodiments of FIGS. 27–38.

FIGS. 27–30 show a mounting system or apparatus 235 for a string of lights 240. String of lights 240 includes plurality of bulbs 284, a plurality of bulb sockets 286 and interconnecting wires 288. Mounting system 235 may include an elongated translucent cover 250 affixed to mounting base 186. Cover 250 has a grooved or faceted inner surface 252, and a pair of side legs 254 which are preferably parallel side legs and which may include a first side leg 256 and a second side leg 258. Side legs 256 and 258 have lower ends 262 and 264 respectively. Side legs 256 and 258 are connected by an arcuately shaped top portion 259. A pair of base panels 266 which may include a first base panel 268 and a second base panel 270 extend inwardly from inner surface 252 at lower ends 262 and 264, respectively. First and second base panels 268 and 270 define a snap channel or slideway 271 therebetween having a width 272.

Figure 30:
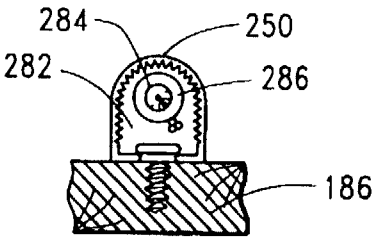
FIG. 30 is an end view in elevation of the components of FIG. 29.
Figure 31:
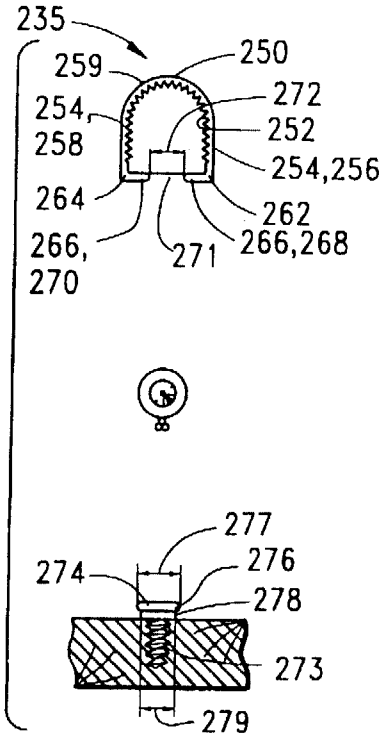
FIG. 31 is an exploded view of an alternative embodiment of a mounting system in side elevation including an illumination cover, a light string, a track channel and a mounting structure.
Figure 32:
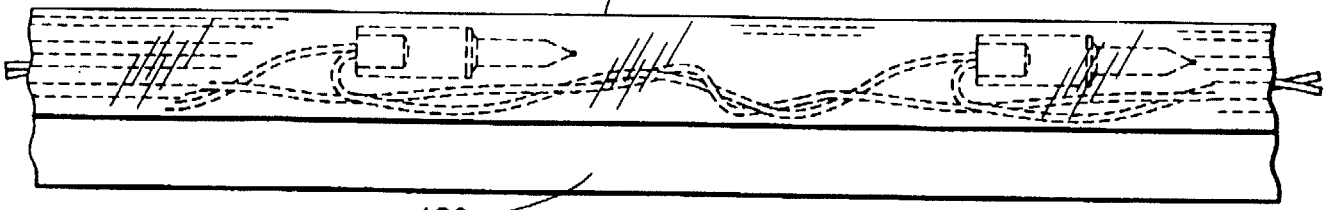
FIG. 32 is an exploded end view of the components of FIG. 31.
Figure 32:
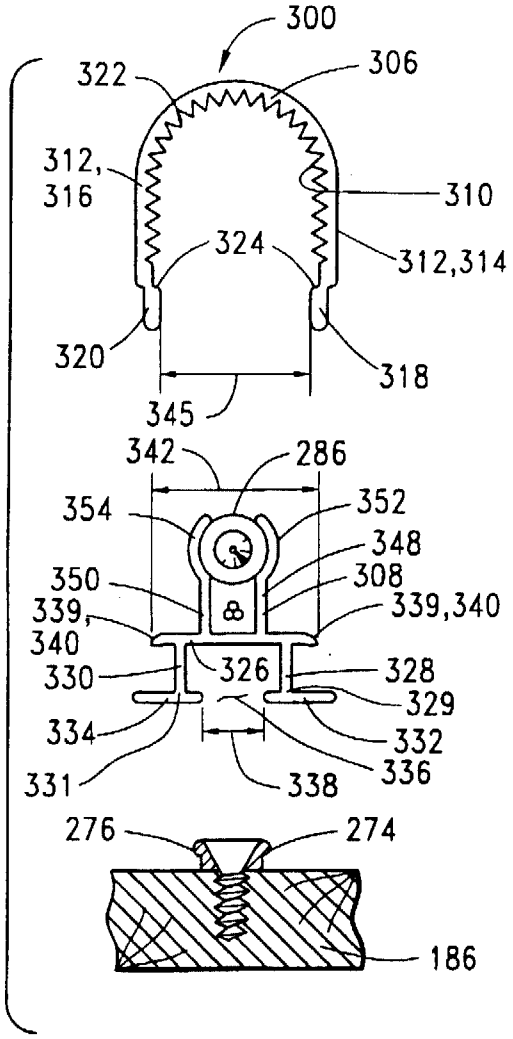
Figure 31:
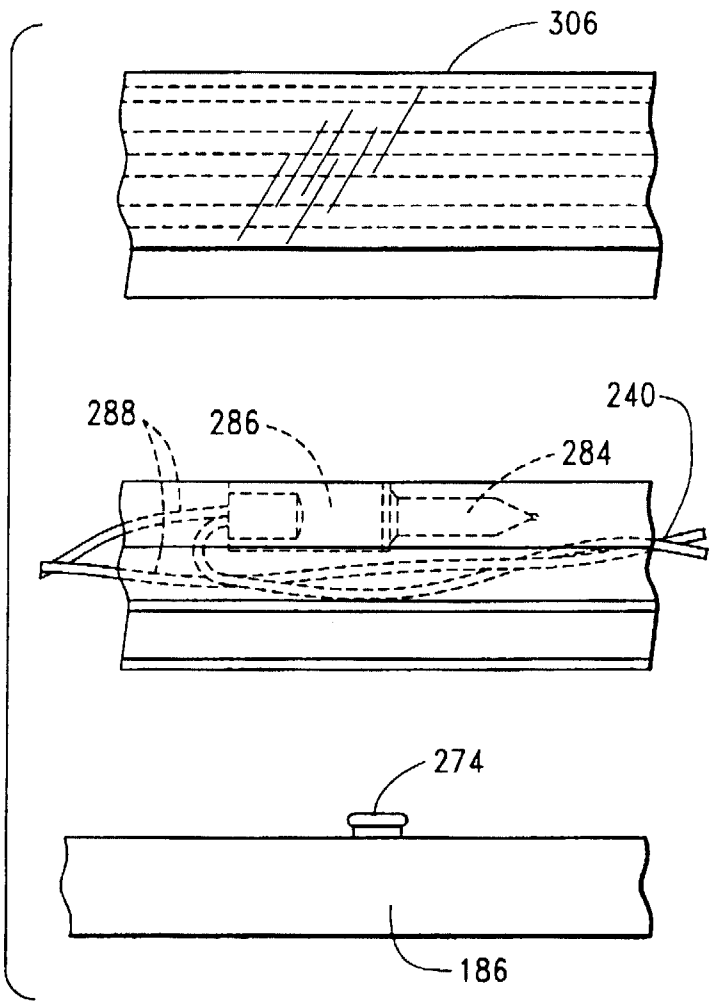
Figure 33:
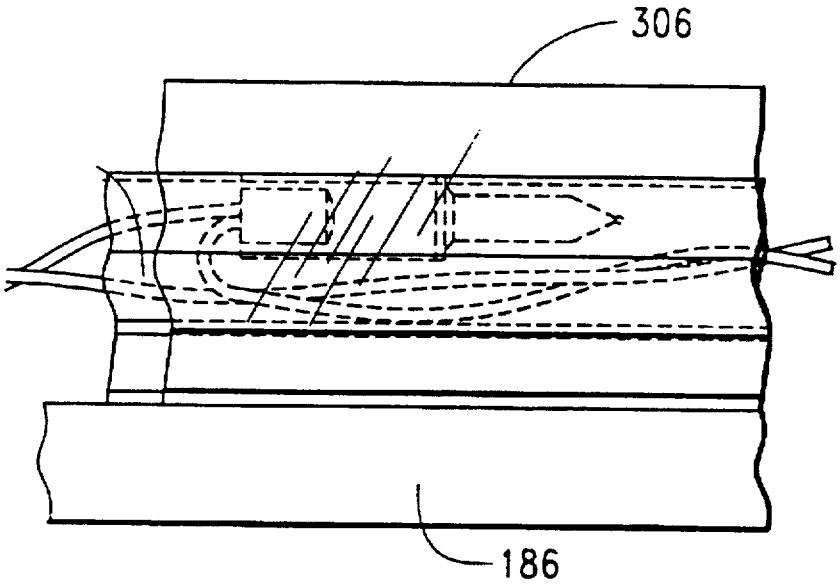
FIG. 33 is a side elevation view of the components of FIG. 31 assembled.
Figure 34:
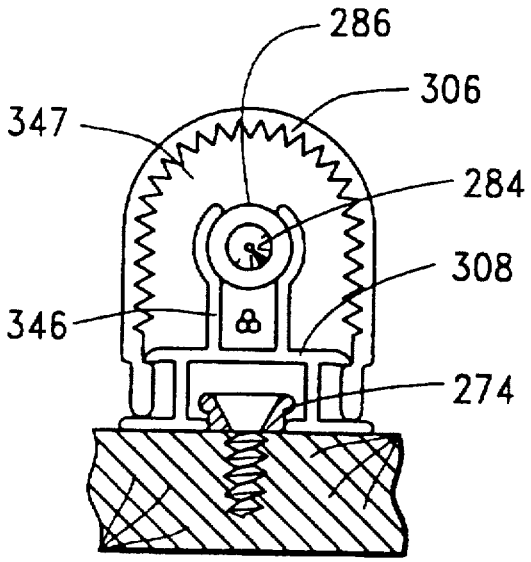
FIG. 34 is an end view in elevation of the assembled components of FIG. 33.

Cover 250 is affixed to mounting base 186 with a plurality of screws or other fasteners 273 and a plurality of snap buttons 274. As is seen in FIGS. 28 and 30, snap button 274 has an upper head or bead portion 276 having a diameter 277 and a neck portion 278 having a diameter 279, which may be the same as or less than width 272. Screws 273 hold the plurality of snap buttons 274 in place. Diameter 277 of upper head portion 276 is greater than width 272 of snap channel 271 so that cover 250 may be snapped over snap button 276 to secure cover 250 to mounting base 186. Cover 250 thus defines and provides an elongated, enclosed space 282 for locating string of lights 240 and, when secured to mounting base 186, cover 250 covers and encloses string of lights 240 thereby securing the lights to mounting base 186. It is also understood that cover 250 may be secured to mounting base 186 with a slide channel 50 illustrated in FIG. 3.

An additional embodiment of a mounting system of the present invention is shown in FIGS. 31–34. Shown therein is a mounting system 300 for mounting string of lights 240 to mounting base 186. Mounting systems 300 may include an elongated translucent cover 306 affixed to mounting base 186 with an elongated track channel 308. Elongated translucent cover 306 is disposed over, and connected to elongated track channel 308 which is secured to mounting base 186 with a plurality of snap buttons 274.

Translucent cover 306 has an inner surface 310 that is faceted or grooved. Translucent cover 306 further includes side legs 312 including a first side leg 314 and a second side leg 316. First and second side legs 314 and 316 are preferably parallel side legs. Side legs 314 and 316 have lower ends 318 and 320 respectively. Side legs 314 and 316 are interconnected by a top portion 322 which is preferably arcuately shaped so that translucent cover 306 may generally be defined as a U-shaped translucent cover. Lower ends 318 and 320 of side legs 314 and 316 are recessed inwardly so that a pair of opposed longitudinal engagement lips 324 are defined on the inner surface of translucent cover 306.

Elongated track channel 308 comprises an upper panel 326 having first and second underside panels, or support legs 328 and 330 extending downwardly therefrom First and second support legs 328 and 330 are preferably parallel. First and second base panels 332 and 334 are disposed at the lower ends 329 and 331 of legs 328 and 330, respectively. Base panels 332 and 334 define a slideway or snap channel 336 having a width 338. Width 338 is less than diameter 277 of snap button 274 so that track channel 308 may be snapped on or otherwise disposed under head portion 2769 thereby affixing track channel 308 to mounting base 186. Upper panel 326 has a pair of opposed outer edges 339 which define outwardly extending flanges 340 disposed along the length of panel 326. Upper panel 326, including flanges 340, has an overall width 342. A width 345 between the lower ends 318 and 320 of first and second side legs 314 and 316, respectively is less than overall width 342 of upper panel 326 so that translucent cover 306 may be snapped over upper panel 326. Flanges 340 will engage lips 324 to hold translucent cover 306 in place thereby securing the cover to track channel 308 so that translucent cover 306 is connected to mounting base 186.

When translucent cover 306 is mounted to mounting base 186 in the above-described manner, translucent cover 306 defines an enclosed, elongated space 347 for locating string of lights 240 and will cover a string of lights disposed therein. Light string 240 may thus be disposed in elongated space 347 along the length of translucent cover 306 and track channel 308. A plurality of bulb clamps 346 may be disposed in space 347 and may extend upwardly from upper panel 326 to hold the lights in place in elongated space 347. Bulb clamps 346 are connected to upper panel 326, which is connected to support legs 320 and 330, which are in turn connected to base panels 332 and 334. Bulb clamps 346 are thus connected to and extend upwardly from each base panel. Bulb clamps 346 may include opposed clamp legs 348 and 350 having arcuately shaped upper clamp portions 352 and 354. Arcuately shaped portions 352 and 354 will engage bulb sockets 286 to hold the individual lights in the string of lights 240 in place in elongated space 247. The track channel thus supports the lights in the elongated space 247. It is understood that mounting system 300 may also be secured to mounting base 186 with slide channels 48 or 50 as illustrated in FIGS. 2 and 3 respectively.

Figure 36:
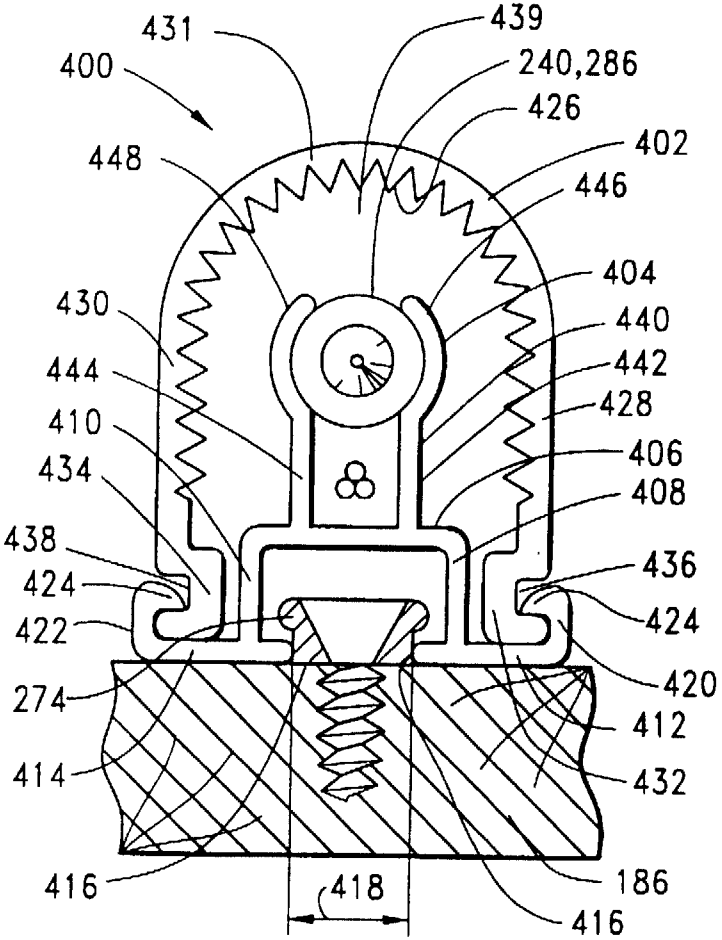
FIG. 36 is an end view in elevation of the assembled components of an alternative embodiment of a mounting system of the present invention including an illumination cover a track channel, a string of lights and a mounting base.
Figure 31:
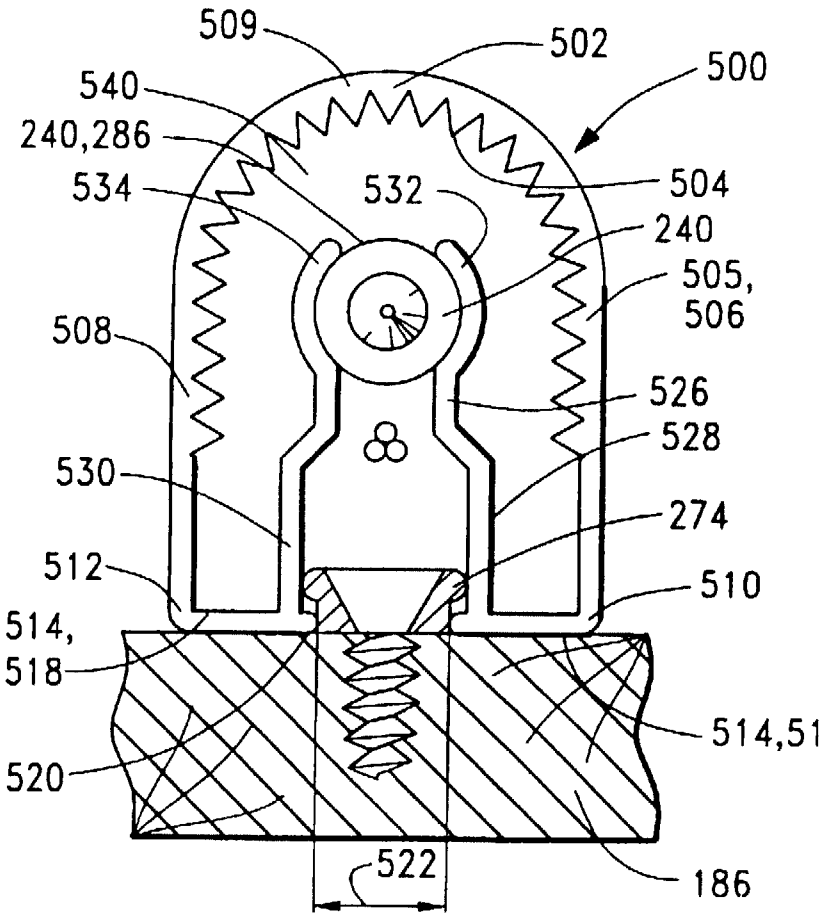
Figure 32:
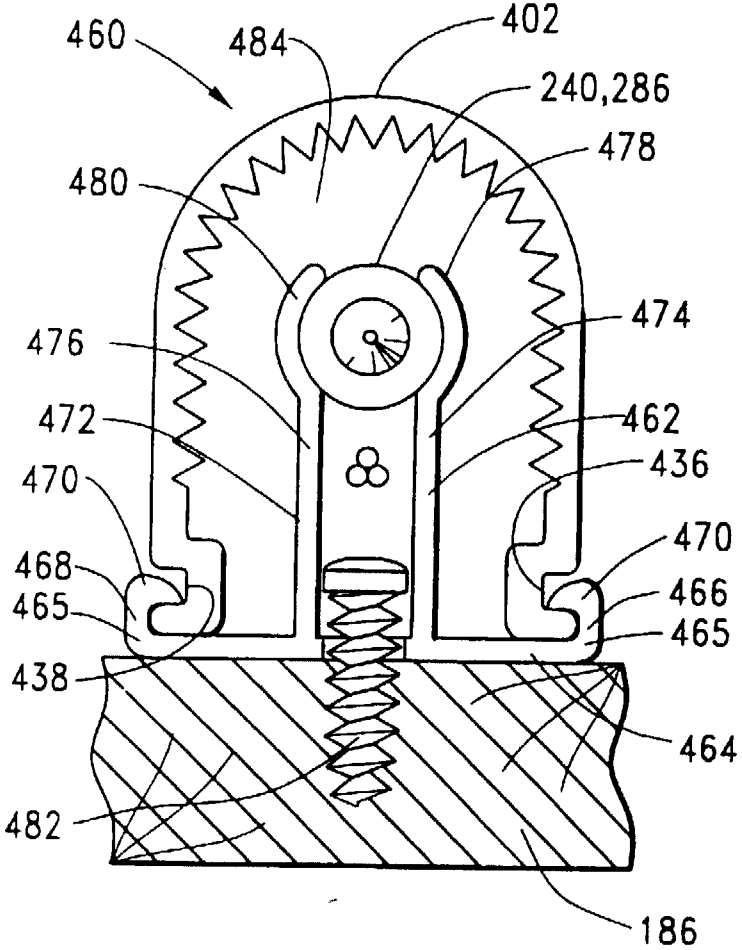

A similar arrangement is shown in FIG. 36. FIG. 36 shows a mounting system 358 including elongated translucent cover 308 in combination with a track channel 360. Track channel 360 includes a base panel 362 which may be secured to mounting base 186 with a plurality of screws 364 or other fasteners known in the art. Base panel 362 has a pair of cover retaining legs including a first retaining leg 366 and a second retaining leg 368 extending upwardly therefrom. Retaining legs 366 and 368 preferably comprise vertical legs having upper ends 370 and 372, respectively. A flange 374 extends outwardly from upper ends 370 and 372 so that the outer edges of flanges 374 define a width 376. Width 376 is greater than width 345 between lower ends of first and second side legs 314 and 316 of cover 308 so that the lower ends thereof may be pulled apart and snapped over flanges 374. Flanges 374 will engage opposed lips 324 thereby securing cover 308 to track channel 360, thus connecting cover 308 to mounting base 186 and defining an enclosed, elongated space 378 for locating string of lights 240. Cover 308 will thus completely cover a string of lights 240 disposed therein. String of lights 240 may be disposed in elongated space 378 by placing bulb sockets 286 in the plurality of bulb clamps 380. Bulb clamps 380 are connected to base panel 362 and include opposed clamp legs 382 and 384 extending upwardly therefrom. The upper ends of clamp legs 382 and 384 may include arcuately shaped upper clamp portions 386 and 388, respectively, for clamping around bulb sockets 286 thereby holding light string 240 in place in elongated space 378.

Figure 35:
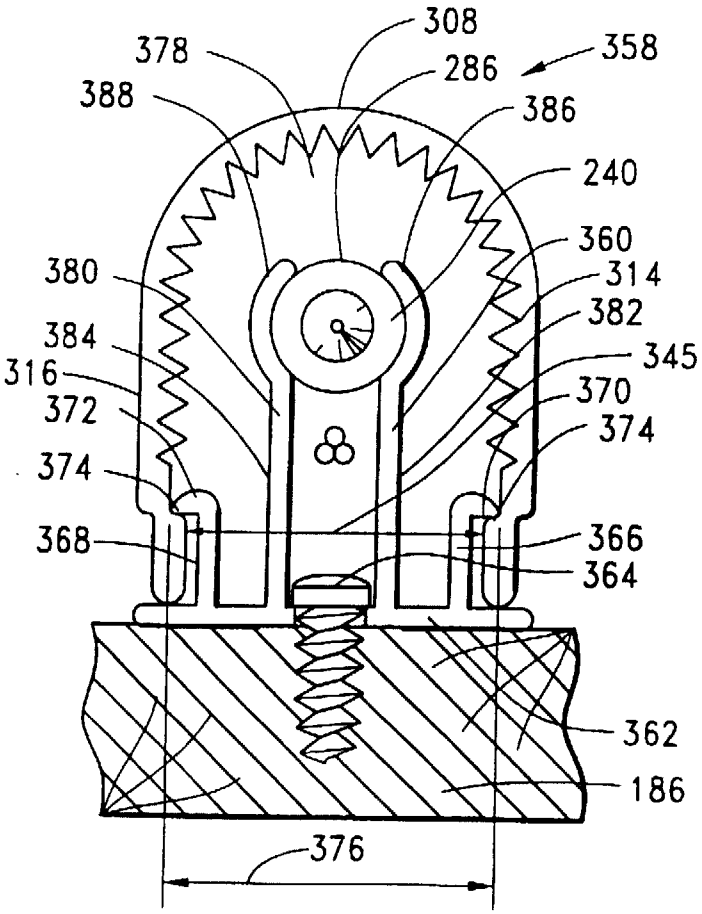
FIG. 35 is an end view in elevation of the assembled components of an alternative embodiment of a mounting system of the present invention including an illumination cover, a track channel, a string of lights and a mounting base.

An additional embodiment of a mounting system 400 is shown in FIG. 35. Mounting system 400 includes an elongated translucent cover 402 connected to base 186 with a track channel 404. Track channel 404 includes an upper panel 406 and includes first and second underside panels, or first and second support legs 408 and 410 extending downwardly therefrom. First and second base panels 412 and 414 are connected to the lower ends of support legs 408 and 410, respectively. A snap channel or slideway 416 having a width 418 is defined by base panels 412 and 414. A pair of cover retaining legs, which may include a first retaining leg 420 and second retaining leg 422, extend upwardly from the outer edges of first and second base panels 412 and 414, respectively. Upwardly extending retaining legs 420 and 422 each have a flange 424 extending inwardly therefrom.

Translucent cover 402 has a faceted or grooved inner surface 426 and has first and second parallel side legs 428 and 430, respectively. Side legs 428 and 430 have lower ends 432 and 434, respectively and are connected by an arcuately shaped top portion 431. Retaining grooves 436 and 438 are defined in side legs 428 and 430 at the lower ends 432 and 434 thereof. Because width 418 of snap channel is less than diameter 277 of head portion 276 of snap button 274, track channel 404 may be snapped or otherwise positioned beneath head portion 276 of snap buttons 274 and thereby secured to mounting base 186. Translucent cover 402 may then be snapped in place so that flanges 424 are received in grooves 436 and 438 thereby securing cover 402 to track channel 404 and thus connecting cover 402 to mounting base 186. When cover 402 is secured in such a manner, an enclosed, elongated space 439 for locating string of lights 240 is provided. String of lights 240 may thus be disposed in elongated space 439 and, as shown in FIG. 35 may be held in place by a plurality of bulb clamps 440 which include first and second clamp legs 442 and 444 extending upwardly from upper panel 406. Because upper panel 406 is connected to base panels 412 and 414, bulb clamps 440 are likewise connected to and extend upwardly from each base panel. First and second clamp legs 442 and 444 may have arcuately shaped clamp portions 446 and 448 defined at the upper ends thereof so that bulb sockets 286 may be received therein and held thereby.

FIG. 37 shows an arrangement similar to that shown in FIG. 35. FIG. 37 shows a mounting system 460 which includes translucent cover 402 and a track channel 462. Track channel 462 has a base panel 464, having a pair of retaining legs, which may include first retaining leg 466 and second retaining leg 468, extending upwardly from the outer edges 465 thereof. Opposed flanges 470 extend inwardly from the upper ends both of first and second retaining legs 466 and 468. Translucent cover 402 may be snapped into position so that flanges 470 are received in grooves 436 and 438 thereby connecting translucent cover 402 to mounting base 186. Track channel 462, which is disposed in cover 402, may be secured to mounting base 186 with a plurality of screws or other fasteners known in the art. Translucent cover 402 thus provides an elongated, enclosed space 484 for locating and positioning string of lights 240 when it is secured to track channel 462 and mounting base 186. The string of lights may be disposed in elongated space 484 with a plurality of bulb clamps 472. Bulb clamps 472 may comprise first and second clamp legs 474 and 476 extending upwardly from base panel 464. Clamp legs 472 and 474 may have arcuately shaped upper clamp portions 478 and 480 defined at the upper ends thereof. Arcuately shaped portions 478 and 480 will engage bulb sockets 286 thereby holding the lights and the light string in place in elongated space 484.

Finally, an additional embodiment of a mounting system of the present invention is shown in FIG. 38 and generally designated by the numeral 500. Mounting system 500 may include a translucent cover 502 having a faceted or grooved inner surface 504 and parallel side legs 505 including first and second side legs 506 and 508 having lower ends 510 and 512 respectively. First and second side legs 506 and 508 are connected by arcuately shaped upper portion 509. Translucent cover 502 may include a pair of opposed base panels 514 which may include a first base panel 516 and a second base panel 518 extending inwardly from the lower ends of first and second legs 506 and 508, respectively. Base panels 516 and 518 define a slideway or snap channel 520 having a width 522. Translucent cover 502 may thus be secured to a mounting base 186 with a plurality of snap buttons 274. The upper bead portion 276 of snap button 274 has a diameter 277 greater than the width 522 of snap channel 520 so that a plurality of snap buttons held in place with a plurality of fasteners will secure translucent cover 502 to mounting base 186.

When translucent cover 502 is secured to mounting base 106, an elongated, enclosed space 540 is provided for placing string of lights 240. String of lights 240 may thus be disposed in space 540 and may be held in place by a plurality of bulb clamps 526. Bulb clamps 526 may include first and second clamp legs 528 and 530 extending upwardly from first and second base panels 516 and 518, respectively. First and second arcuately shaped upper clamp portions 532 and 534 may be disposed at the upper ends of first and second clamp legs 528 and 530 respectively. Bulb socket 286 of each individual light in the string of lights may be placed between arcuately shaped portions 532 and 534 to hold the lights and thus the string of lights in place in space 540. As shown in FIG. 38, bulb clamps 526 may be integrally formed with track cover 502. It should be understood that whenever a plurality of snap buttons are taught as a means of attachment to a mounting base, the slide channels 48 or 50, shown in FIGS. 2 or 3 respectively, may be used to provide "slide-on" mounting as opposed to snap-on mounting.

Figure 25:
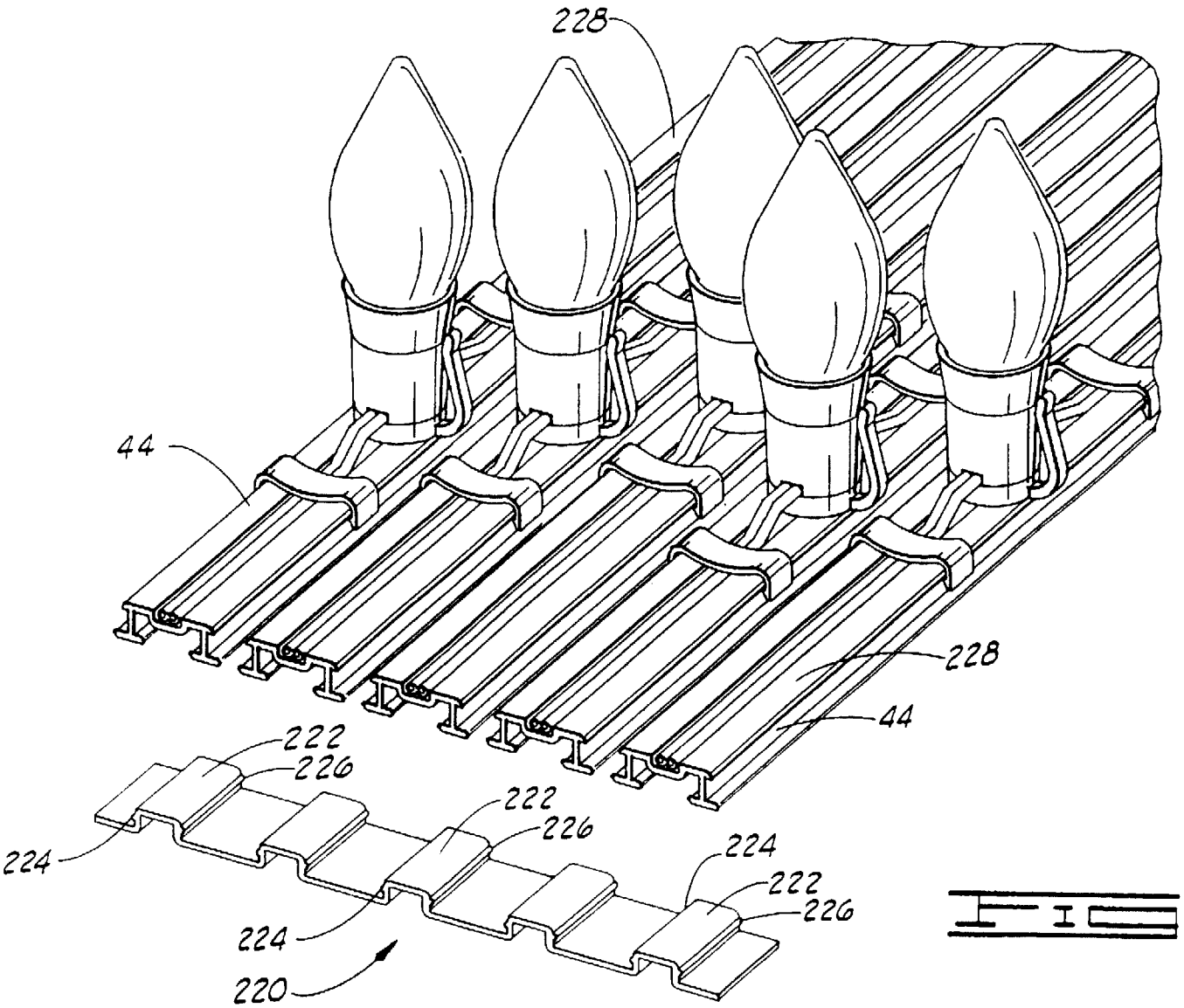
FIG. 25 is a perspective view of a plurality of light track assemblies arrayed in storage mode as coupled by a plurality of storage clips.
Figure 25:
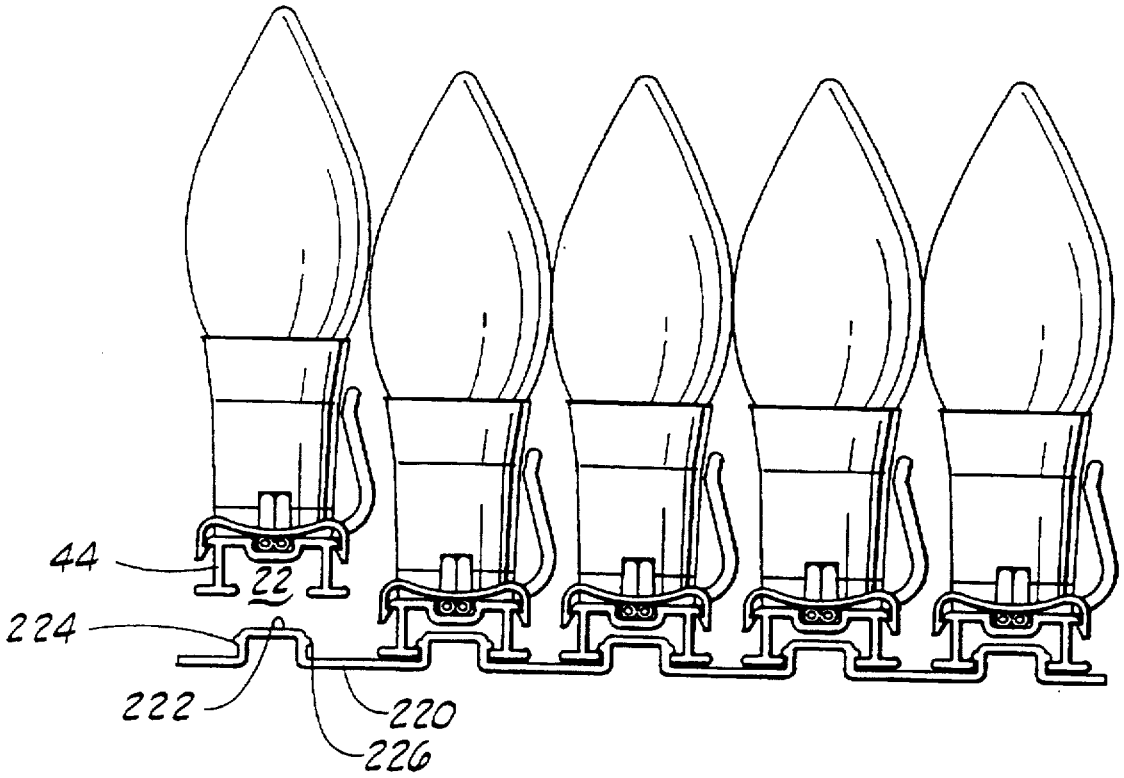
Figure 27:
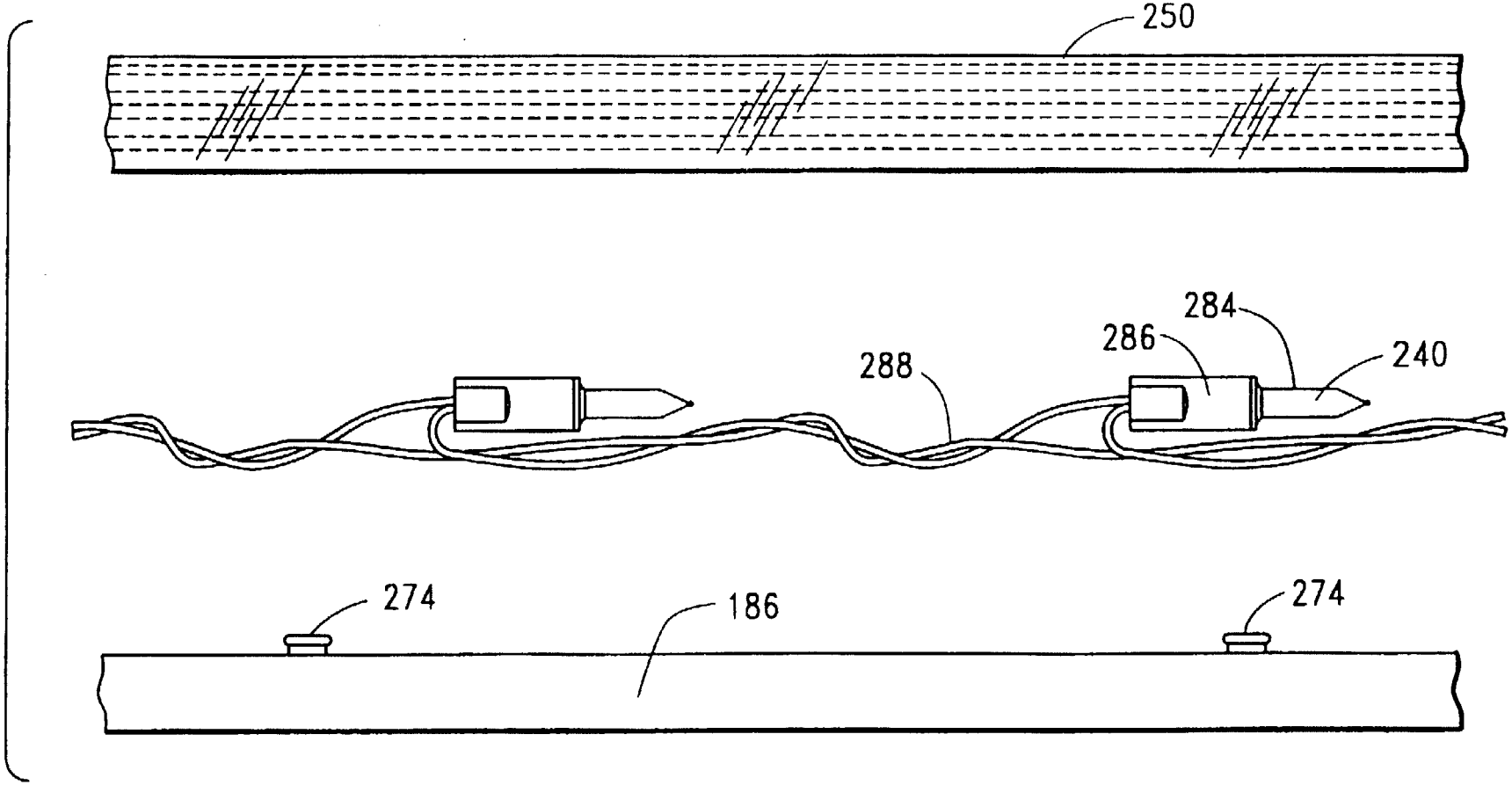
FIG. 27 is an exploded view in side elevation of a mounting system including an illumination cover, a string of lights, a mounting structure and snap buttons secured to the mounting structure.

FIGS. 25 and 26 illustrate the use of a multiple track clip 220 as used for retaining a plurality of assembled track sections for storage and transportation. The storage clips 220 may also be cut from extruded stock to provide a plurality of clips 220 having equi-spaced lugs 222, each having opposite side interference beads 224 and 226. The lighting system can then be broken down into the elemental lighting tracks 228, i.e., individual track channels 44 with light strings attached, and the individual channels 22 (FIG. 1) of track channels 44 are snapped onto respective lugs 222 to assemble a multiple of track channels 44 together for transportation or storage. Suitable storage schemes and carriers are shown and described in the aforementioned related patent application, Ser. No. 08/429,895, now U.S. Pat. No. 5,513,081.

The foregoing discloses a number of alternative structures that may be utilized in formation of a track lighting system of a type that is readily deployed, transported and stored. Such lighting systems may be readily deployed for rapid put-up and take-down for holiday seasons or other occasions, and the systems are more easily stored in their assembled condition. Lighting systems constructed in accordance with the present invention provide great time savings in installation and a considerable reduction in loss from breakage. Thus, the present invention enables transport and storage of a relatively large number of lights on one or more light strings, with the entire storage rack and light string assembly being light in weight and of a size that is not unwieldy.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Mounting apparatus for affixing a string of lights having a plurality of bulb sockets interconnected with connecting wires to a mounting base comprising:

an elongated track channel said track channel comprising:

an upper panel having opposed outer edges;

a pair of support legs extending downwardly from said upper panel; and a base panel attached to a lower end of each of said support legs, said base panels being adapted to be secured to said mounting base; and a plurality of retaining clips connected to said upper panel wherein said retaining clips retain said string of lights in place along said track channel upper panel.

2. The apparatus of claim 1, wherein said upper panel is substantially flat, said upper panel having flanges disposed at the outer edges thereof, and wherein said retaining clip comprises:

a central portion;

opposed side shoulders extending downward from said central portion; and tooth flanges extending inwardly from said side shoulders wherein said tooth flanges grip the outer edges of said upper panel to hold said string of lights in place.

3. The apparatus of claim 1 wherein said retaining clip captures said connecting wires between said clip and said upper panel to retain said string of lights in place along said upper panel.

4. The apparatus of claim 2 wherein each said retaining clip has opposed outer edges, said retaining clip having a wire bundle clip extending upward from at least one of said outer edges thereof for capturing said connecting wires and holding said string of lights in place along said track channel.

5. The apparatus of claim 1, wherein said retaining clips are secured to said bulb sockets thereby retaining said string of lights in place along said upper panel.

6. The apparatus of claim 1 wherein said upper panel comprises:

a substantially flat central portion;

a pair of opposed retaining legs extending upwardly from the outer edges of said central portion, said opposed retaining legs having flanges defined thereon wherein said retaining clips engage said retaining leg flanges thereby retaining said string of lights along said track channel.

7. The apparatus of claim 6 wherein said retaining clips are attached to said bulb sockets.

8. The apparatus of claim 6, said flanges on said retaining legs extending inwardly from said retaining legs, wherein said retaining clips snap between said retaining legs and are received beneath said flanges.

9. The mounting apparatus of claim 6, said retaining leg flanges extending outwardly from said side shoulders, wherein said retaining clips comprise a central portion and opposed side shoulders extending downwardly therefrom, said side shoulders having flanges extending inwardly therefrom for engaging said retaining leg flanges.

10. Mounting apparatus for securing a string of lights to a mounting site comprising:

a track channel, said track channel comprising:

a base panel adapted to be secured to said mounting site;

retaining legs extending upwardly from said base panel; and flanges defined at the upper ends of said retaining legs; and retaining clips attached to said track channel for retaining said string of lights therealong, wherein said retaining clips engage said flanges on said retaining legs to hold said retaining clips in place.

11. The mounting apparatus of claim 10 wherein said flanges defined on said track channel retaining legs extend outwardly away from each other, and wherein said retaining clips comprise a central portion and opposed side shoulders extending downwardly therefrom, said shoulders having flanges extending inwardly therefrom to engage said flanges on said track channel retaining legs.

12. The mounting apparatus of claim 10 wherein said flanges on said retaining legs extend inwardly toward each other, and wherein said retaining clip fits between said retaining legs and is received beneath said flanges.

13. The apparatus of claim 10, wherein said retaining clips are attached to bulb sockets included in said string of lights.

14. A mounting apparatus for securing a string of lights to a mounting site comprising:

a track channel comprising a pair of substantially flat base panels defining a slot therebetween, said base panels being adapted to be secured to said mounting site; and a plurality of bulb clamps connected to and extending above said base panels, wherein each said bulb clamp is adapted to hold one of a plurality of bulb sockets included in said string of lights thereby holding said string of lights in place along said track channel.

15. The apparatus of claim 14 wherein said track channel comprises:

an upper panel;

a pair of support legs connected to and extending downwardly from said upper panel; and said base panels being connected to a lower end of each of said support legs, said bulb clamps being connected to said upper panel.

16. The apparatus of claim 15, wherein said bulb clamps are integrally formed with said upper panel.

17. The apparatus of claim 15, said bulb clamps comprising a pair of opposed clamp legs extending upwardly from said upper panel, wherein said bulb socket is received between said opposed clamp legs.

18. The apparatus of claim 17, said opposed clamp legs having arcuately shaped upper portions, said bulb sockets being received between said arcuately shaped upper portions.

* * * * *